US006551224B1

(12) United States Patent
Lim

(10) Patent No.: US 6,551,224 B1
(45) Date of Patent: Apr. 22, 2003

(54) FUNCTIONAL RECLINING MULTI-USE EXERCISE APPARATUS

(76) Inventor: Edgar Lim, 2024 St. John, Highland Park, IL (US) 60035

( * ) Notice: Subject to any disclaimer, the term of this patent is extended or adjusted under 35 U.S.C. 154(b) by 0 days.

(21) Appl. No.: 09/864,854

(22) Filed: May 24, 2001

Related U.S. Application Data

(63) Continuation-in-part of application No. 09/422,671, filed on Oct. 21, 1999, now Pat. No. 6,299,570.

(51) Int. Cl.[7] ..... A63B 26/00
(52) U.S. Cl. ..... 482/142; 482/148
(58) Field of Search ..... 482/146, 147, 482/142, 907, 908, 122–123, 129–131, 148, 71, 69, 70; 297/133, 33, 272, 50, 318, 56, 18, 30, 129; 128/71–74

(56) References Cited

U.S. PATENT DOCUMENTS 4,278,288 A * 7/1981 Thebaud ..... 217/118
5,080,353 A * 1/1992 Tench ..... 272/144
5,104,119 A * 4/1992 Lynch ..... 482/5
5,246,268 A * 9/1993 Lerner et al. ..... 297/133
5,295,930 A * 3/1994 Hogan ..... 482/71
5,906,566 A * 5/1999 Whitcomb ..... 482/130
6,024,677 A * 2/2000 Siwertz ..... 482/96
6,213,923 B1 * 4/2001 Cameron et al. ..... 482/142
6,354,657 B1 * 3/2002 Nelson et al. ..... 297/56

OTHER PUBLICATIONS www.power.systems.com Muscle Maxx™ Pro Line (Catalgue) pp 31–33.
www.power.systems.com (Catalogue) p. 55.

* cited by examiner

*Primary Examiner*—Jerome W. Donnelly
*Assistant Examiner*—Lori Baker Amerson
(74) *Attorney, Agent, or Firm*—Adrienne B. Naumann, Esq.

(57) ABSTRACT

A functional reclining multipurpose exercise apparatus. When completely assembled in a small space, the apparatus is useful for numerous muscle strengthening exercises. The functional reclining multipurpose exercise apparatus comprises removable leg attachments as well as adjustors and pin attachments. There are also exercise stretch bands which encircle specific components of the apparatus for resistance, depending upon the particular exercise.

8 Claims, 25 Drawing Sheets

200
260c
203c
203b
300
203a
260b
260a
251a
250
254c
250
254b
250f
254a
500d
500c
707a
55b
55a
508b
508a
701b
706a

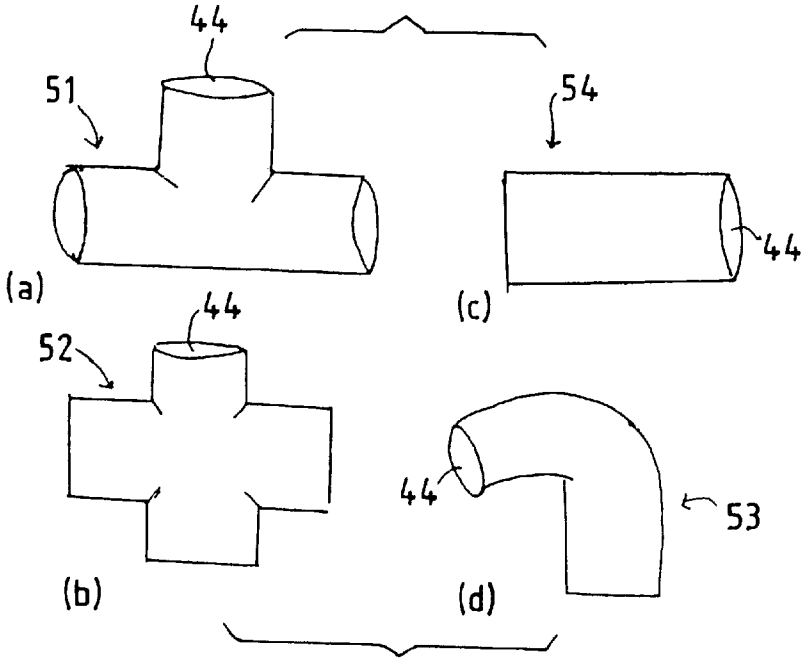
FIG. 16
FIG. 15
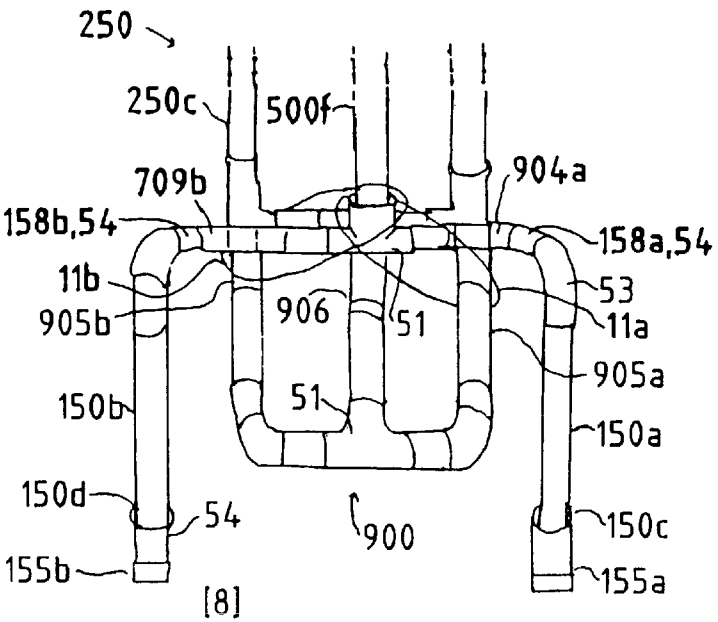

[8]

[8]

FUNCTIONAL RECLINING MULTI-USE EXERCISE APPARATUS

This application is a continuation in part of U.S. utility application No. 09/422,671, filed on Oct. 21, 1999 now U.S. Pat. No. 6,299,570, which is incorporated by reference in its entirety.

BACKGROUND OF THE INVENTION

The invention is a functional reclining multi-use exercise apparatus, with which a person may perform numerous exercises in a variety of positions. The exercise aparatus is also adjustable to fit a user's body size and exercise requirements.

Proper use of the functional reclining multi-use exercise apparatus improves muscle strength of the entire body, especially of the upper body. However, the functional reclining multi-use exercise apparatus is also effective for the lower body and other muscle groups.

These muscles include those of the upper body trunk such as: pectorals, deltoids, trapezius, rhomboids, infraspinatus and latissumus dorsi, biceps brachii, triceps, teres(major and minor), erector spinae, supraspinatus, flexor and extensor of the forearm groups.

The invention has a discontinuous base as well as an elevated angled framework and angled removable legs. There are also adjustors which change length and height of the functional reclining multiuse exercise apparatus. There is color banding for proper assemble of the apparatus, which assists a home user or a convalescing user with quick manual assembly.

Conventional exercise equipment does not provide a lightweight design and easy assembly by a convalescing individual. Nor does the prior art provide numerous exercise options within a portable lightweight structure which is easily disassembled and placed in a duffel bag. For example the MUSCLE MAXX™ Pro Line provides separate pieces of adjustable larger equipment, which however is very cumbersome.

In particular, the Pro Lat exercise device by MUSCLE MAXX™ has an adjustable seat and thigh pads. However, this device is also heavier and comprises weights which are an integral part of the device's design. The Kep Home Gym comprises a steel frame for muscle strength exercise. However, the Keys Home Gym 250 is heavier and more cumbersome than the exercise apparatus.

It also appears not as easily adjustable, and is difficult to manually assemble by one person. Finally, the Keyes Home Gym 250 and 2300A also does not provide a structure of a person's reclining position.

SUMMARY OF THE INVENTION

The invention is a functional reclining multi-use exercise apparatus, with which a person may exercise upon a rigid supporting horizontal surface in a small area. Proper use of the functional reclining multi-use exercise apparatus improves muscle strength of the entire body, especially upper body. However, the functional reclining multi-use exercise apparatus is also effective for the lower body and other muscle groups. These muscles include those of the upper body trunk such as the pectorals, deltoids, trapezius, rhomboid, infraspinatus, latissumus dorsi, teres(minor and major), erector spinae, biceps brachii, triceps, flexor and extensor of the forearm groups.

The invention has a discontinuous base with components comprising upwardly protruding vertical support pipes and a plurality of connectors in the preferred embodiment. There are also adjustors which change length and height of the framework simultaneously. The significance of color banding is to properly assemble appropriate parts of the invention.

Accordingly, one purpose of the functional reclining multipurpose exercise apparatus is to incorporate numerous exercise techniques into one portable exercise device.

Another purpose of the functional reclining multipurpose exercise apparatus is to accommodate persons who must recline while performing their exercises.

Another purpose of the functional reclining multipurpose exercise apparatus is to allow easy assembly with color coded components, which are manually taken apart and reassembled within a short period of time.

Another purpose of the functional reclining multipurpose exercise apparatus is to allow use in a relatively small area for a variety of muscle strengthening exercises.

Another purpose of the functional reclining multipurpose exrcise apparatus is to allow manual use for convalescing individuals who must move or adjust the apparatus or adjust it without assistance.

Another goal of the apparatus is to provide a home exerise device which is an economical investment.

These and other uses and goals of the functional reclining multipurpose exercise apparatus will become clear after the detailed discussion of the preferred embodiment and other embodiments, infra.

BRIEF DESCRIPTION OF THE DRAWINGS

FIG. 15 illustrates in top plan isolated view, angled leg attachments and lower attached assembly with two bunge cords.

FIG. 16*a* is a lateral view of a t-joint connector.

FIG. 16*b* is a lateral view of a four member cross connector.

FIG. 16*c* is a lateral view of a two-end extension connector.

FIG. 16*d* is a lateral view of a angled connector.

DETAILED DESCRIPTION OF THE PREFERRED EMBODIMENT AND OTHER EMBODIMENTS

Figure 1:
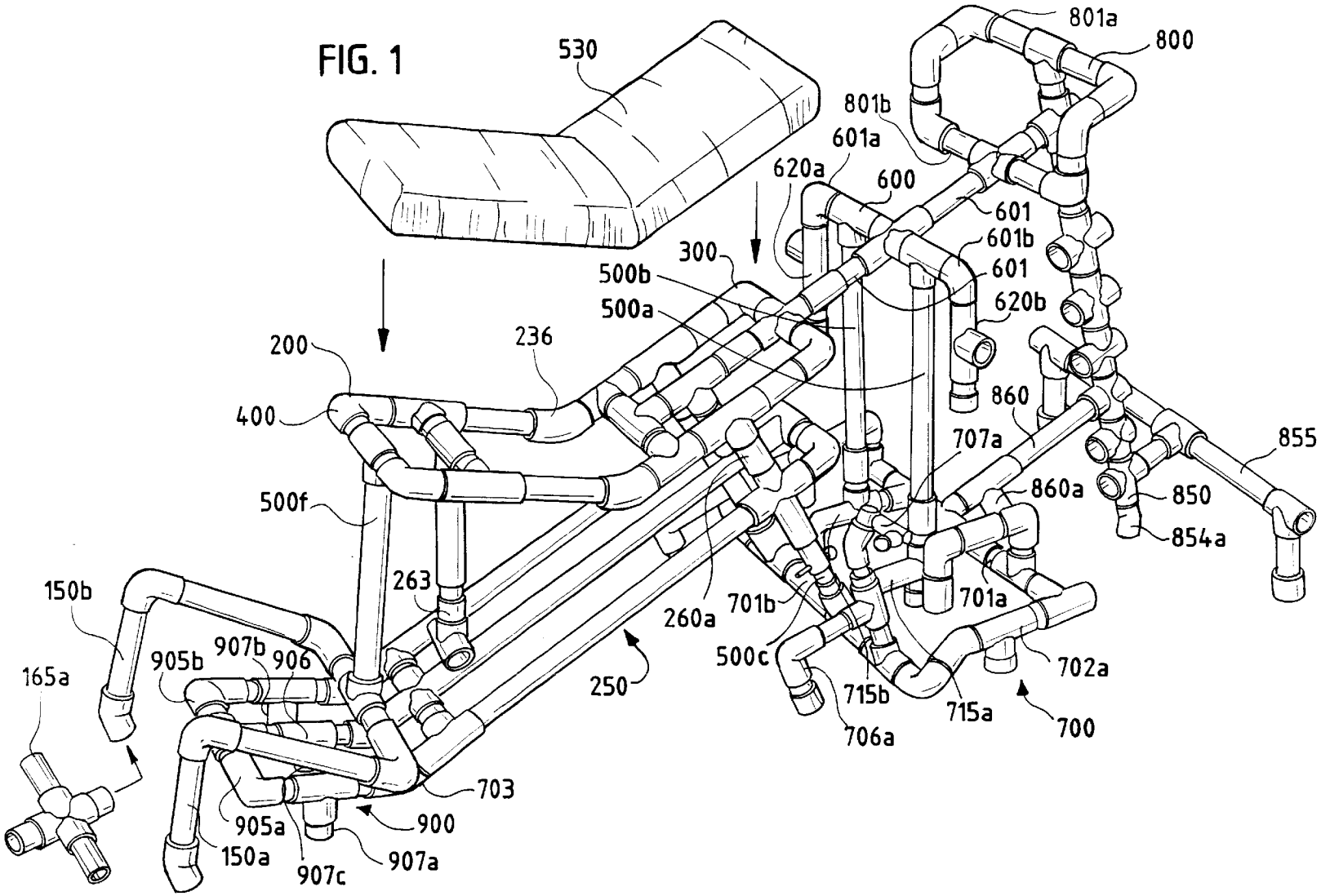
FIG. 1 illustrates a partial lateral view of the fully assembled functional reclining multipurpose exercise apparatus with a removable reclining framework pad.

As seen in FIG. 1, the functional reclining multipurpose exercise apparatus 100 comprises an elevated angled framework 200 at an angle of approximately 60 degrees to a rigid supporting horizontal surface 8. In the preferred embodiment, the entire assembled functional reclining multiuse exercise apparatus 100 is approximately 93 inches in length. Also in the preferred embodiment, the apparatus is approximately three feet in height, and approximately nineteen inches in width in a non-adjusted position. All the exercises described for use with the apparatus 100 are well known in the physical therapy and personal training industry.

Elevated Angled Framework

Figure 2:
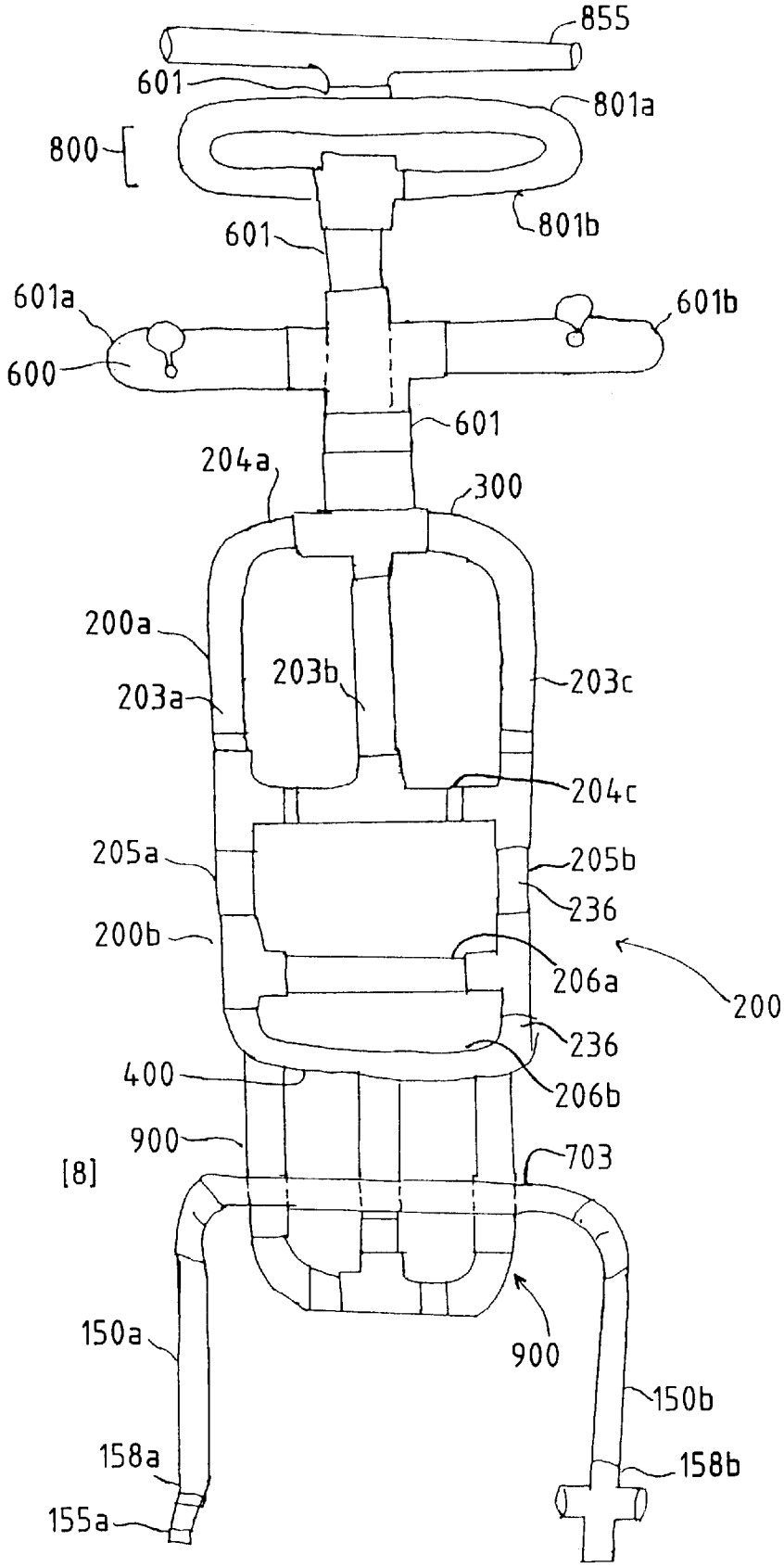
FIG. 2 illustrates a schematic top plan view of the elevated angled framework with associated components.

Referring now to FIGS. 1 and 2, elevated angled framework 200 is approximately 11 inches wide in the preferred embodiment. Elevated angled framework 200 has a bend 236 at approximately its midline of approximately 30 degrees from a rigid horizontal supporting surface 8.

Elevated angled framework 200 has a first upper end 300 and a second lower end 400. The height of elevated angled framework 200 at upper end 300 is approximately 24 inches from rigid horizontal supporting surface 8 in the preferred embodiment. Second lower end 400 is approximately 21 inches from rigid horizontal supporting surface 8.

Referring to FIG. 2, elevated angled framework 200 comprises a first portion 200*a* and a second portion 200*b*. First portion 200*a* comprises three adjacent parallel pipes 203*a*, 203*b*, 203*c*.

Each adjacent parallel pipe 203*a*, 203*b*, 203*c* is connected to an upper perpendicular pipe 204*a* and a lower perpendicular pipe 204*b*.

Second portion 200*b* of elevated framework 200 comprises second end 400 and also comprises first lateral pipe 205*a* and a second lateral pipe 205*b*. First lateral pipe 205*a* and second lateral pipe 205*b* are connected to each other in parallel relationship by a third perpendicular pipe 206*a* and a fourth perpendicular pipe 206*b*.

Back Support Pipe

Referring again to FIGS. 1 and 2, elevated angled framework 200 is attached at upper end 300 to back support pipe 600. Back support pipe 600 is connected to elevated angled framework 200 by elongated connecting segment 601. Back support pipe 600 serves as a back support when a user reclines upon elevated framework 200. Back support pipe 600 has a first support end 601*a* and a second support end 601*b*. Each support end 601*a*, 601*b* comprises first detachable downward extension 620*a* and a second detachable downward extension 620*b* respectively.

Handle Attachment

Referring again to FIGS. 1 and 2, also connected along elongated connecting segment 601 and above back support pipe 600 is handle attachment 800. Handle attachment 800 comprises first horizontal handle 801*a* and second horizontal handle 801*b*. Handle attachment 800 attaches to back support pipe 600 by elongated connecting segment 601. The length of each first and second handle segment 801*a*,801*b* is approximately 16 inches, hand handle segments 801*a*,801*b* are attached to each other by angled connectors 53, infra, and pipe segments 55. Handle attachment 800 serves as a back support and leg curl exercise support.

Chain Support Pipe

Referring now to FIGS. 1 and 10*b*, handle attachment 800 is connected to a diagonally oriented linear chain support pipe 850 by a four member cross connector 52 and a t-joint connector 51 in the preferred embodiment. As best seen in FIG. 10*b*, chain support pipe 850 has an upper chain end 850*a* which is directly attached to a t-joint connector 51, and a lower chain end 850*b*. Chain support pipe 850 also comprises support foot 854*a* at lower chain end 850*b* for support upon rigid horizontal supporting surface 8. Foot 854*a* comprises an angled connector 53. A four member cross connector 52 attaches chain support pipe 850 to elongated connecting segment 601.

Figure 20:
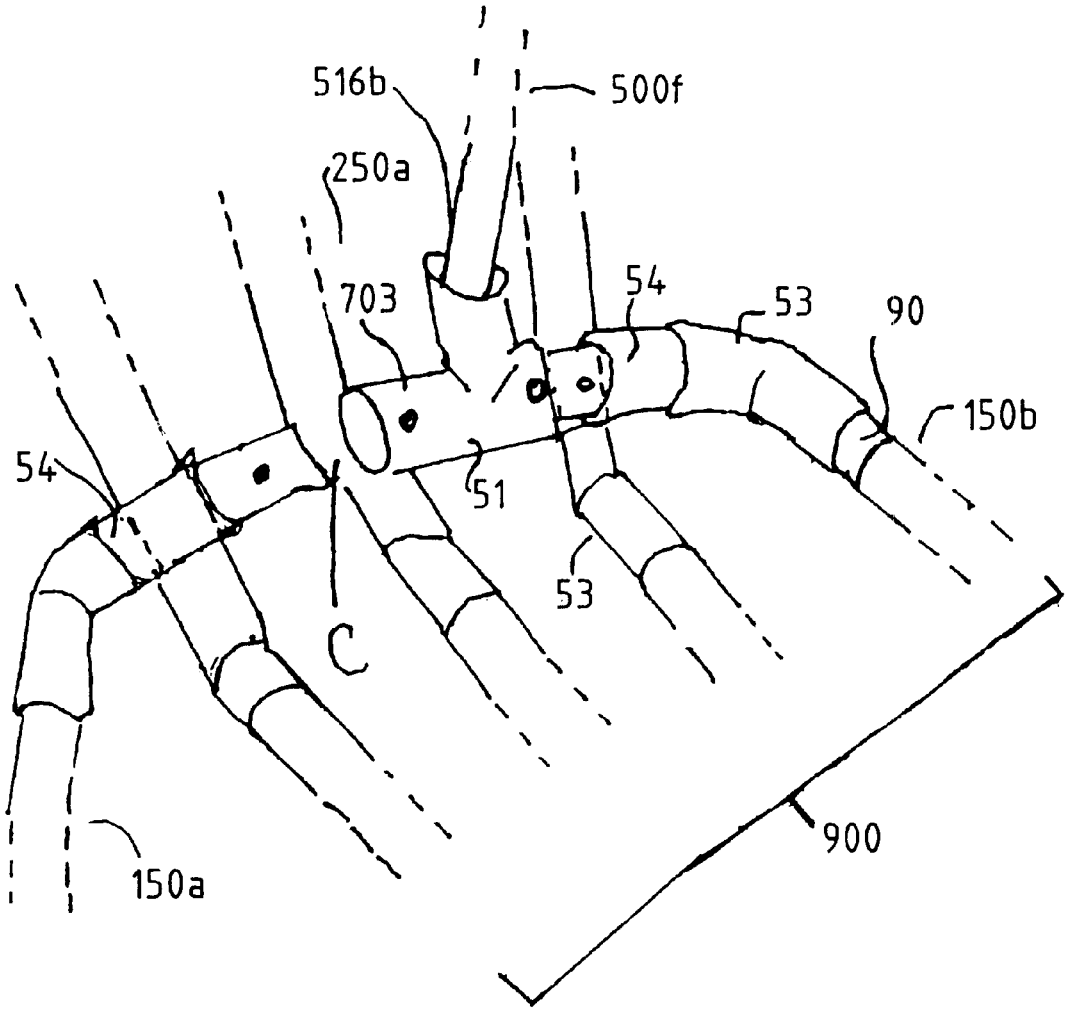
FIG. 20 illustrates in isolated view the assembly point for with angled leg attachments.

As seen in FIGS. 10*b* and 20, chain support pipe 850 also comprises a linear series of four member cross connectors 52 (thus giving it a chain-like appearance), for adjustable attachment of removable horizontal leg support bar 855, infra, as seen in FIG. 10*a*.

Figure 11:
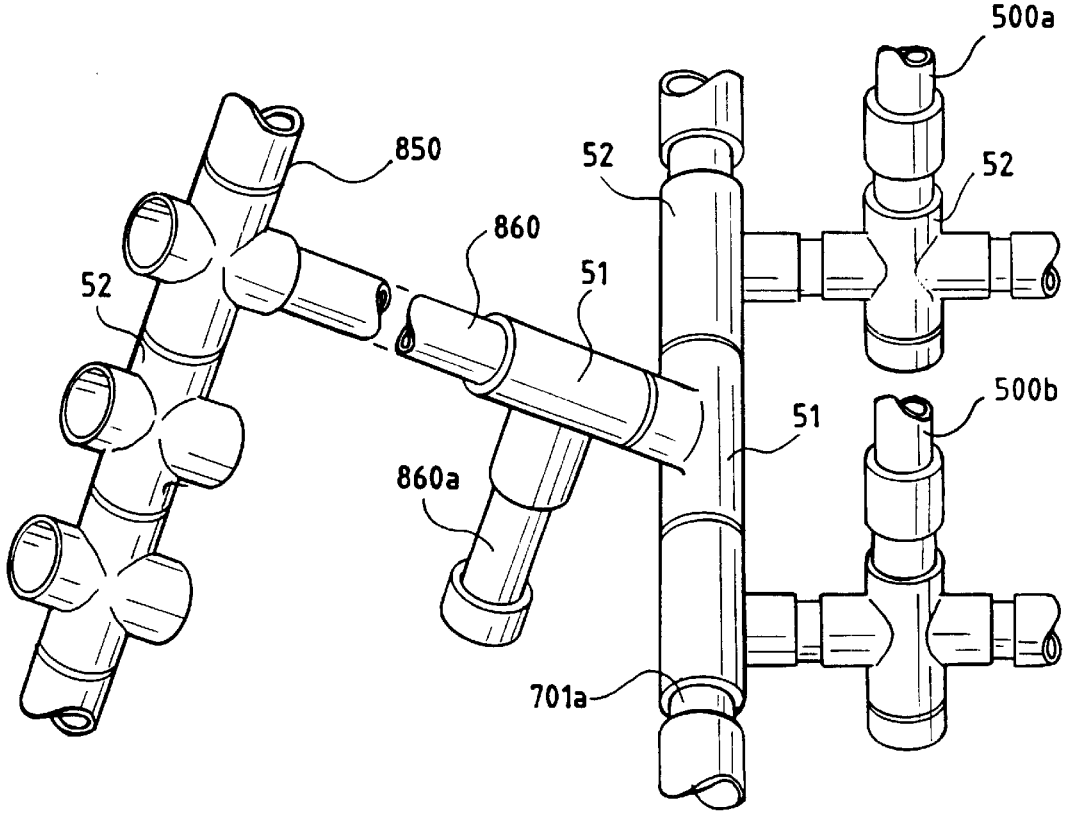
FIG. 11 illustrates in isolated partial lateral view, the connecting pipe between chain support pipe and first transverse connecting pipe.

As seen in FIG. 11, also removably inserted into any four member cross connector 52 of slanted support pipe 850 is bracing pipe 860. Bracing pipe 860 has a second supporting foot 860*a* comprised of a pipe segment 55 and a pipe cap 56. Bracing pipe 860 is removably attached to first transverse connecting pipe 701*a*, infra. Because of the plurality of four member cross-connectors 52 in linear alignment, chain support pipe 850 is adjustable to several heights for lower back, hip extensions and hamstring (leg curl) exercises.

The length of chain support pipe 50 is approximately 38 inches in the preferred embodiment.

Removable Horizontal Leg Support Bar

Figure 18:
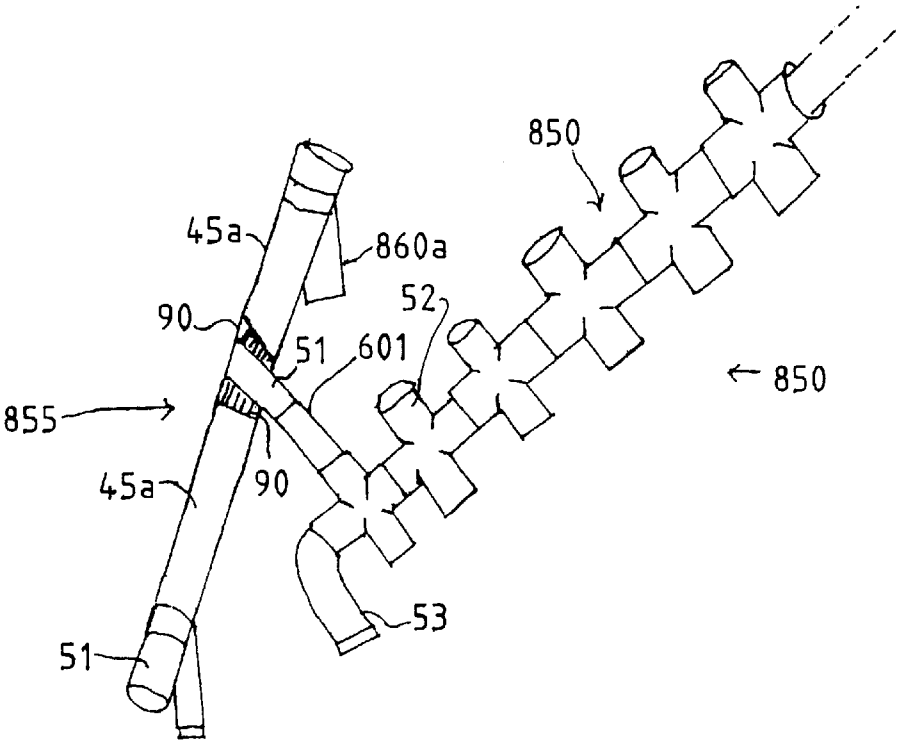
FIG. 18 illustrates a partial isolated lateral view of chain support pipe and tape pads on horizontal foot support bar.

As seen in FIGS. 1 and 18, removable horizontal leg support bar 855 is reversibly attached to chain support pipe 850 by an opposing t-joint connector 51 fitting within a four member cross connector 52.

When so connected, removable horizontal leg support bar 855 serves as a knee support while the user performs calf raises and/or leg curls. It is also useful for calf raises and as an upper leg stabilizer: This means that for hip extensions or leg curl exercise, the removable horizontal leg support bar 855 becomes a support for the one leg which is immobile. The length of removable leg support bar 855 is approximately 24 inches.

Lower Slanted Framework

Figure 7A:
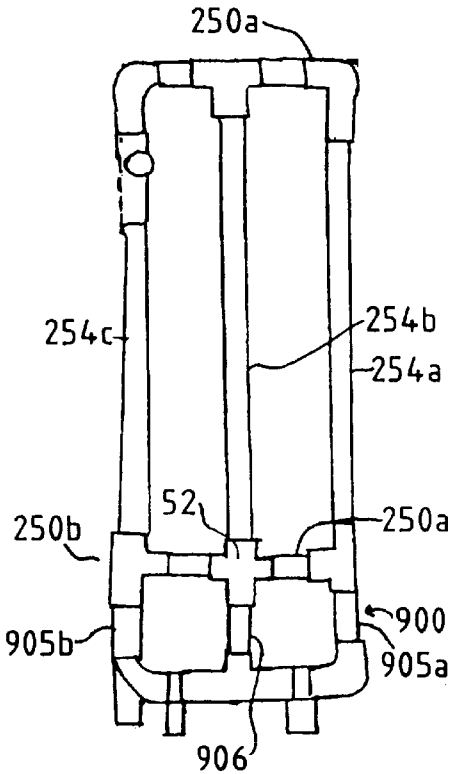
FIG. 7*a* is a top plan schematic view of lower slanted framework.
Figure 7B:
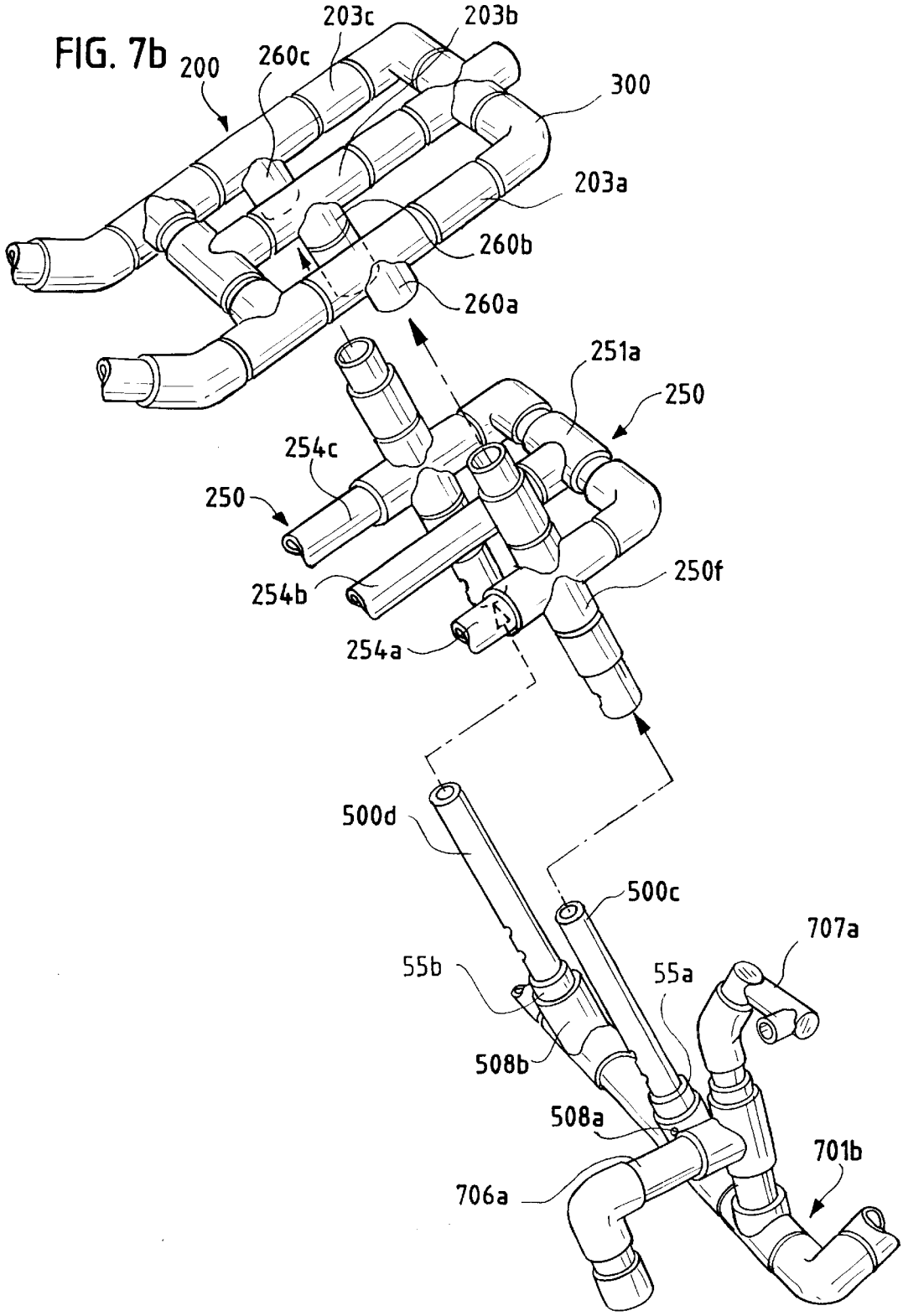
FIG. 7*b* is a closeup lateral view of short attachers connecting elevated angled framework to lower slanted framework.

Referring to FIGS. 1,7*a* and 7*b*, lower slanted framework 250 is positioned below elevated angled framework 200 in a spaced parallel relation to elevated angled framework 200.

Lower slanted framework 250 has a third upper end 250*a* and a fourth lower end 250*b*. It also comprises a first parallel pipe 254*a*, a second parallel pipe 254*b* and a third parallel pipe 254*c*. Fourth lower end 250*b* comprises a second attachment 900, which in the preferred embodiment comprises two lateral pipe segments 905*a*,905*b* and a central pipe segment 906.

Figure 9:
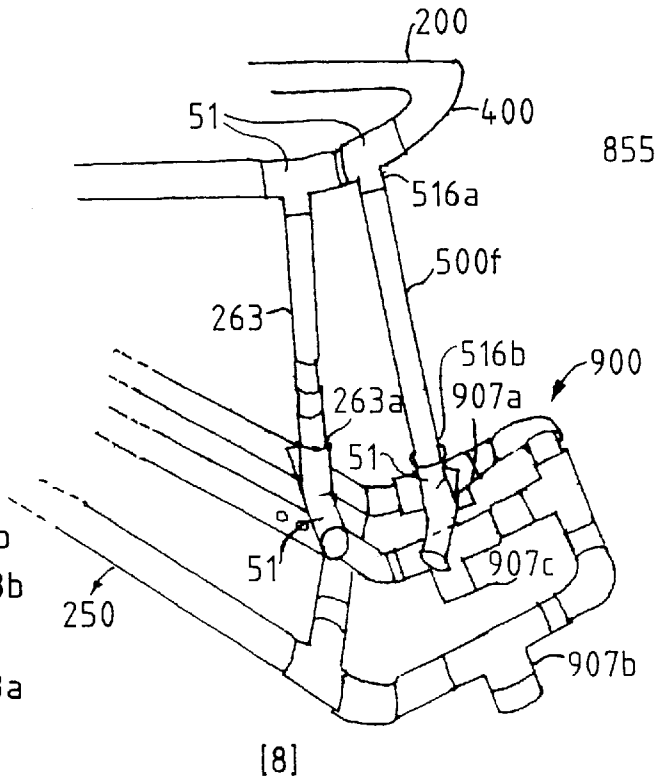
FIG. 9 illustrates an isolated partial lateral view of lower attached assembly with adjustable support pipe and a third rotating slanted support pipe without angled legs.

As seen in FIG. 9, lateral pipe segments 905*a*, 905*b* and central pipe segment 906 each comprise a small foot 907*a*, 907*b*, 907*c* respectively, for mechanical support of second attachment 900 upon rigid horizontal supporting surface 8. The length of each lateral pipe segment 905*a*, 905*b* and central pipe 906 is approximately ten inches in the preferred embodiment.

As best seen in FIGS. 1 and 7*c*, in the preferred embodiment, elevated slanted framework 200 and lower slanted framework 250 are physically attached to each other in vertical spaced parallel relation by first, second and third upper rigid attachers 260*a*, 260*b*, 260*c* respectively. Each upper rigid attacher is 260*a*, 260*b*, 260*c* is physically attached at its upper end to lower surface 201 of elevated angled framework 200. Their respective lower ends attach to upper surface 251*a* of lower slanted framework 250.

Discontinuous Base

Figure 21:
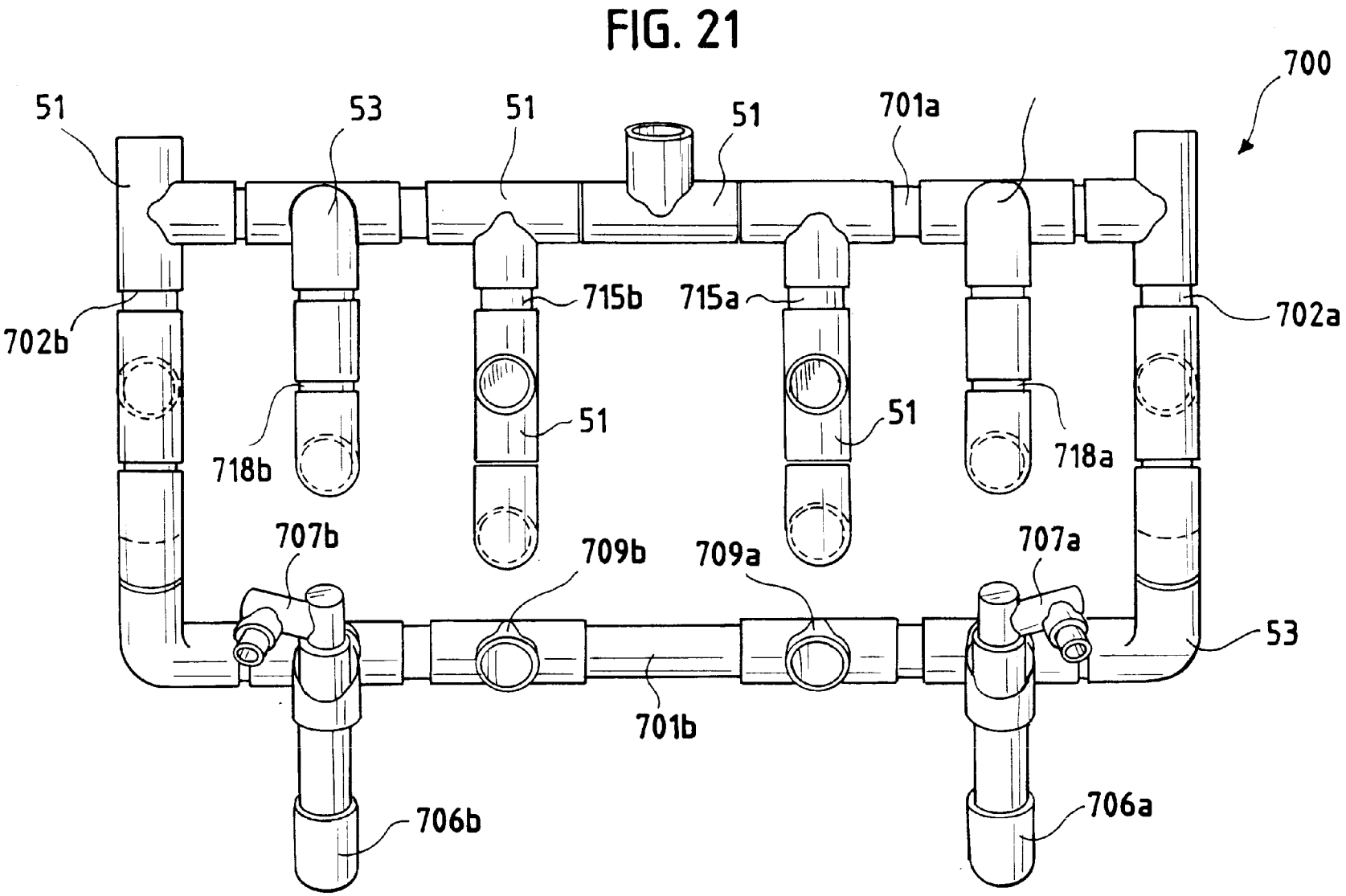
FIG. 21 illustrates in isolated partial anterior view, the discontinuous base.

Referring now to FIGS. 1 and 21, elevated angled framework 200 and lower slanted framework 250 are partially supported by discontinuous base 700. Discontinuous base 700 minimally comprises a first transverse connecting bar 701*a* and a second transverse connecting bar 701*b*.

In the preferred embodiment, first transverse connecting bar 701*a* and second transverse connecting bar 701*b* are connected to each other in parallel relation by first perpendicular piece 702*a* and second perpendicular piece 702*b*. The length of discontinuous base 700 is approximately 16 inches.

Second transverse connecting bar 701*b* comprises first upward extension 706*a* and second upward extension 706*b*. Extensions 706*a*,706*b* stabilize discontinuous base 700 with third and fourth foot supports 262*a*,262*b* respectively.

Each upward extension 706*a*,706*b* comprises a first upwardly protruding angled closed end 707*a* and a second upwardly protruding angled closed end 707*b*. Each upwardly protruding angled closed end 707*a*, 707*b* in turn comprises a first band extension peg 707*c* and a second band extension peg 707*d*. Upwardly reaching t-joint connectors 51 on second transverse connecting bar 701*b* receive the lower ends of third and fourth extensions 706*a*,706*b*.

Each removable upwardly protruding closed end 707*a*, 707*b* serves as exercise stretch band handle, infra, in combination with band extension bars 707*c*,707*d*. This function is particularly important when the user performs chest flies, chest presses, rowing and bicep curls.

In the preferred embodiment, first transverse connecting bar 701*a* comprises a first laterally protruding component 715*a* and a second laterally protruding component 715. Both laterally protruding components 715*a*,715*b* rest at their distal ends upon horizontal rigid supporting surface 8.

First laterally protruding component 715*a* and second laterally protruding component 715*b* connect first transverse connecting bar 701*a* to first and second vertical support pipes 500*a*, 500*b*.

Support pipes 500*a*, 500*b* in turn, connect to back support bar 600 at their upper ends. Laterally protruding components 715*a*, 715*b* each comprise one t-joint connector 51 for insertion of each lower end of first vertical support pipe 500*a* and second vertical support pipe 500*b*, infa, respectively.

Each laterally protruding component 715*a*,715*b* also comprises a first foot and a second foot 715*c*,715*d* upon a rigid horizontal support surface 8. First transverse connecting bar 701*a* also comprises first doubled angled segment 708*a* and second double angled segment 708*b*.

Support Pipes

Figure 24:
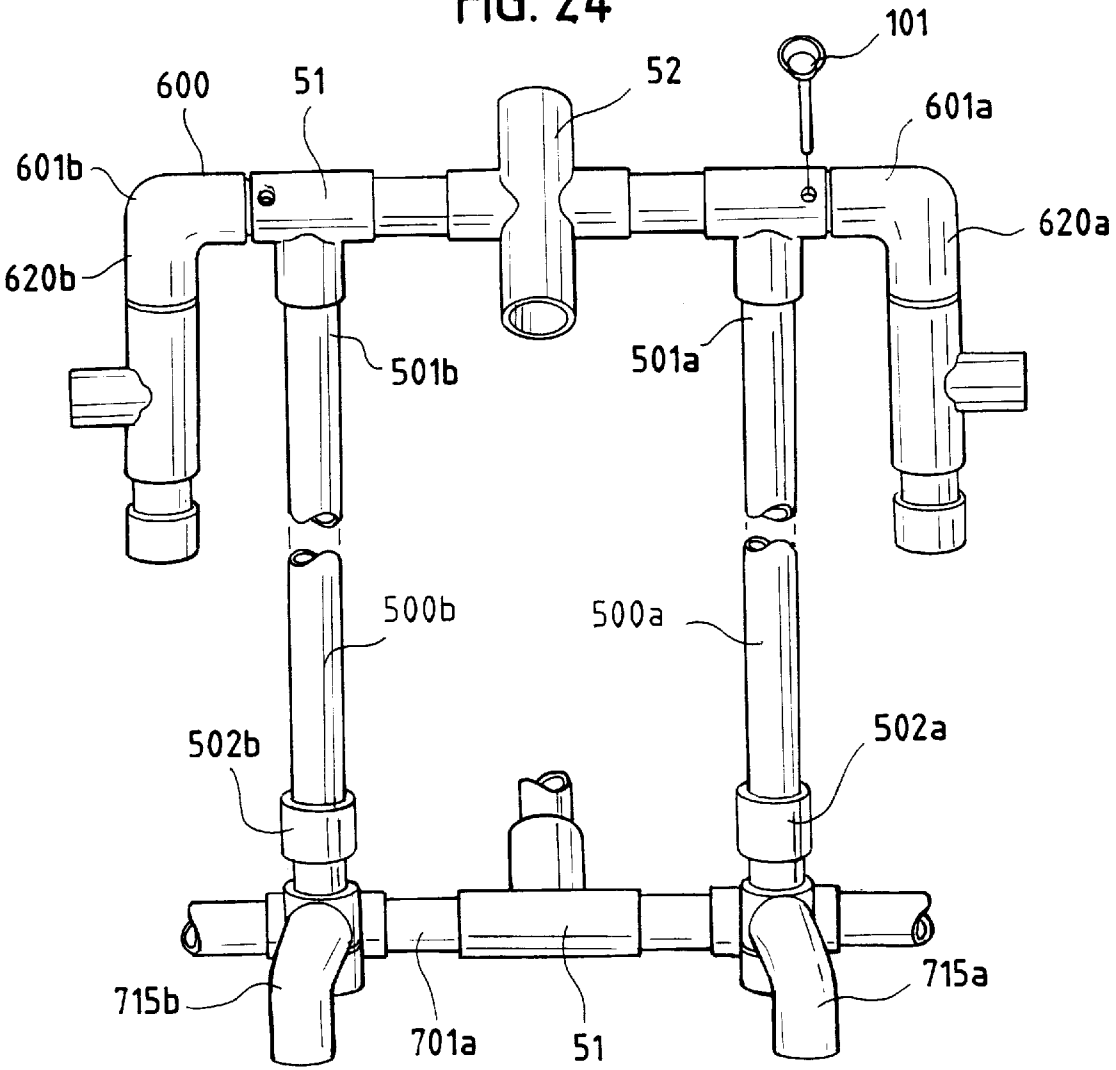
FIG. 24 illustrates an isolated posterior view of first vertical support pipe and second vertical support pipe.
Figure 25:
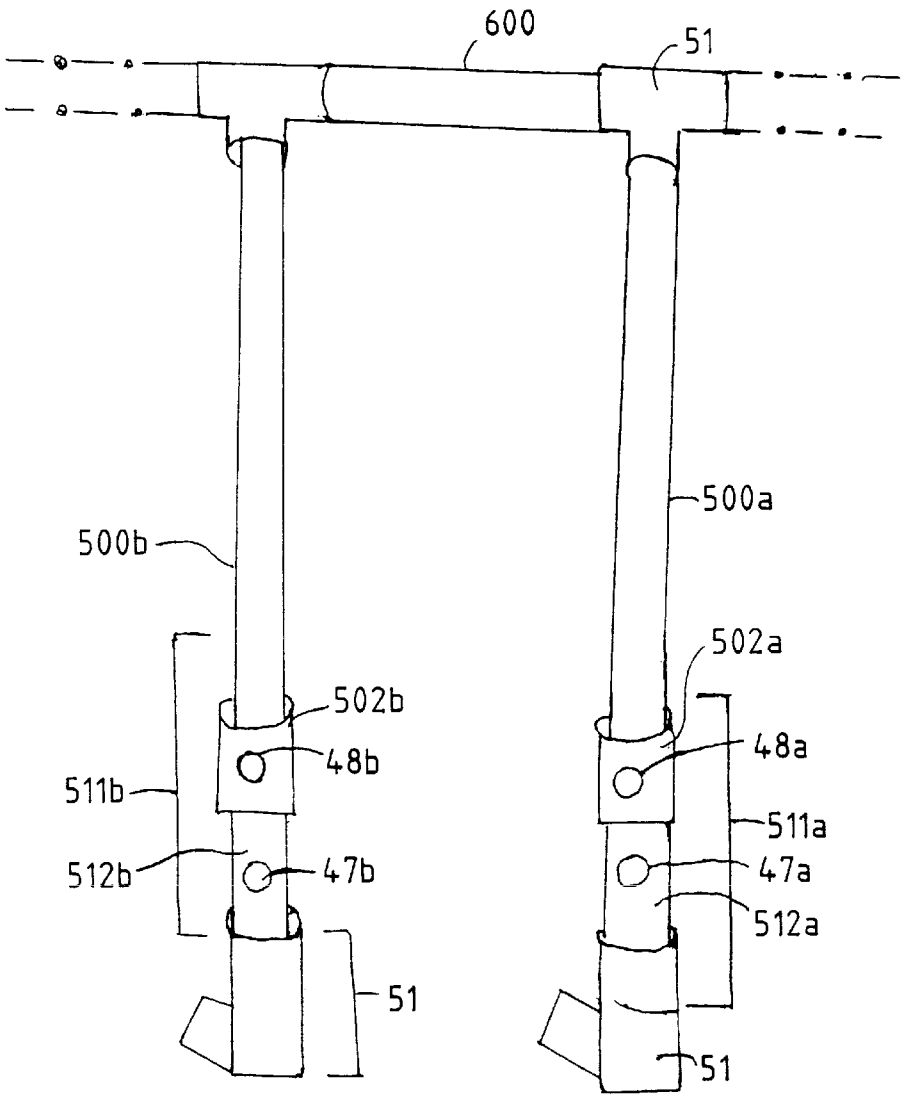
FIG. 25 illustrates an isolated posterior view of first vertical adjustor and second vertical adjustor.

First vertical support pipe and second vertical support pipe Referring now to FIGS. 1 and 24, back support pipe 600 attaches to first vertical support pipe 500*a* at its upper end 501*a*. Back support pipe attaches to second vertical support pipe 500*b* at its upper end 501*b*. Upper ends 501*a*, 501*b* of first vertical support bars 500*a*, 500*b* respectively insert into lower surface 603 of back support bar 600. This is done with t-joint connectors 51 in the preferred embodiment.

Again referring to FIG. 24, first laterally protruding component 715*a* and second laterally protruding component 715*b* receive removable lower wider pipe segments 502*a*, 502*b* of vertical support pipes 500*a*, 500*b* respectively. In the preferred embodiment each attachment is made with four member cross connectors 52 which contain smaller diameter pipe segment 55*f*. In the preferred embodiment, first transverse connecting bar 701*a* also comprises a first loop brace 718*a* and a second loop brace 718*b*. Braces 718*a*,718*b* generate tension when looped with a stretch exercise band 170, infra.

First and Second Angled Support Pipes

Referring now to FIGS. 1 and 7*b*, first angled support pipe 500*c* and second angled support pipe 500*d* are attached at their second lower ends 508*a*,508*b* respectively to second transverse connecting bar 701*b*. These attachments are preferably made by tjoint connectors 51.

First and second angled support pipes 500*c*, 500*d* respectively are proximal to lower angled framework upper end 250*a* when viewed laterally. First and second angled support pipes 500*c*,500*d* attach at their first upper ends 507*a*,507*b* respectively to lower surface 250*c* of lower slanted framework 250. The preferred mode of attachment to lower surface 250*c* are four member cross connectors 52 and a two-end extension connector 54, infra, whereby each two-end extension connector 54 is immediately adjacent to a four member cross connector 52.

Rotating Slanted Support Pipe

Referring now to FIGS. 1 and 9, the length of rotating slanted support pipe 500*f* is approximately 14 inches in the preferred embodiment. Upper end 516*a* of rotating slanted support pipe 500*f* is attached to lower end 400 of elevated angled framework 200. Rotating slanted support pipe 500*f* is preferably attached at its lower end 516*b* to first angled leg 150*a* and second angled leg 150*b*, but which are not shown in this view. Elevated angled framework 200 is partially supported by rotating slanted support pipe 500*f*. Rotating slanted support pipe 500*f* also rotates around a t-joint connector 51 at its upper end on elevated angled framework 200, thus allowing rotation in an arc.

Adjustable Support Pipe

Referring again to FIGS. 1 and 9, adjustable support pipe 263 contacts, but does not attach to, lower slanted framework 250. Adjustable support pipe 263 does not attach to lower slanted framework 250 upper surface at its lower end. However, adjustable support pipe 263 is preferably attached to elevated angled framework 200 by a tjoint connector 51.

Angled Legs

Referring now to FIGS. 1 and 15, each first angled leg 150*a* and second angled leg 150*b* is attached at its proximal end 158*a*, 158*b* restively, to rotating slanted support bar 500*f*. This attachment is preferrably by a terminal t-joint connector 51.

Each angled leg 150*a*,150*b* comprises a downwardly oriented bend of approximately 60 degrees at its midpoint, by attachment of two pipe segments 55 with an angled connector 53. The length of each angled leg 150*a*, 150*b* is approximately 14 inches in the preferred embodiment between each distal leg end 150*c*, 150*d* and their respective attaching angled connectors 53. Angled legs 150*a*,150*b* function as foot rests for reclining exercises. Attachment 165*a*, infra, is useful for exercises which are performed one leg at a time.

Still referring to FIG. 15, in the preferred embodiment, at each proximal end 158*a*, 158*b* of each angled leg 150*a*, 150*b* respectively is a polyvinylchloride angled 2 opening connector 53. Each first angled leg 150*a* and second angled leg 150*b* also comprises a first distal leg end 150*c* and a second distal leg end 150*d* respectively.

Each first distal leg end 150*c* and second distal leg end 150*d* comprise a third central foot 155*a* and a fourth central foot 155*b* respectively. Third central foot 155*a* and fourth central foot 155*a* support each angled leg 150*a*, 150*b* respectively upon rigid horizontal supporting surface 8. Each central foot 155*a*,155*b* comprises a single angled connector 53.

Figure 23:
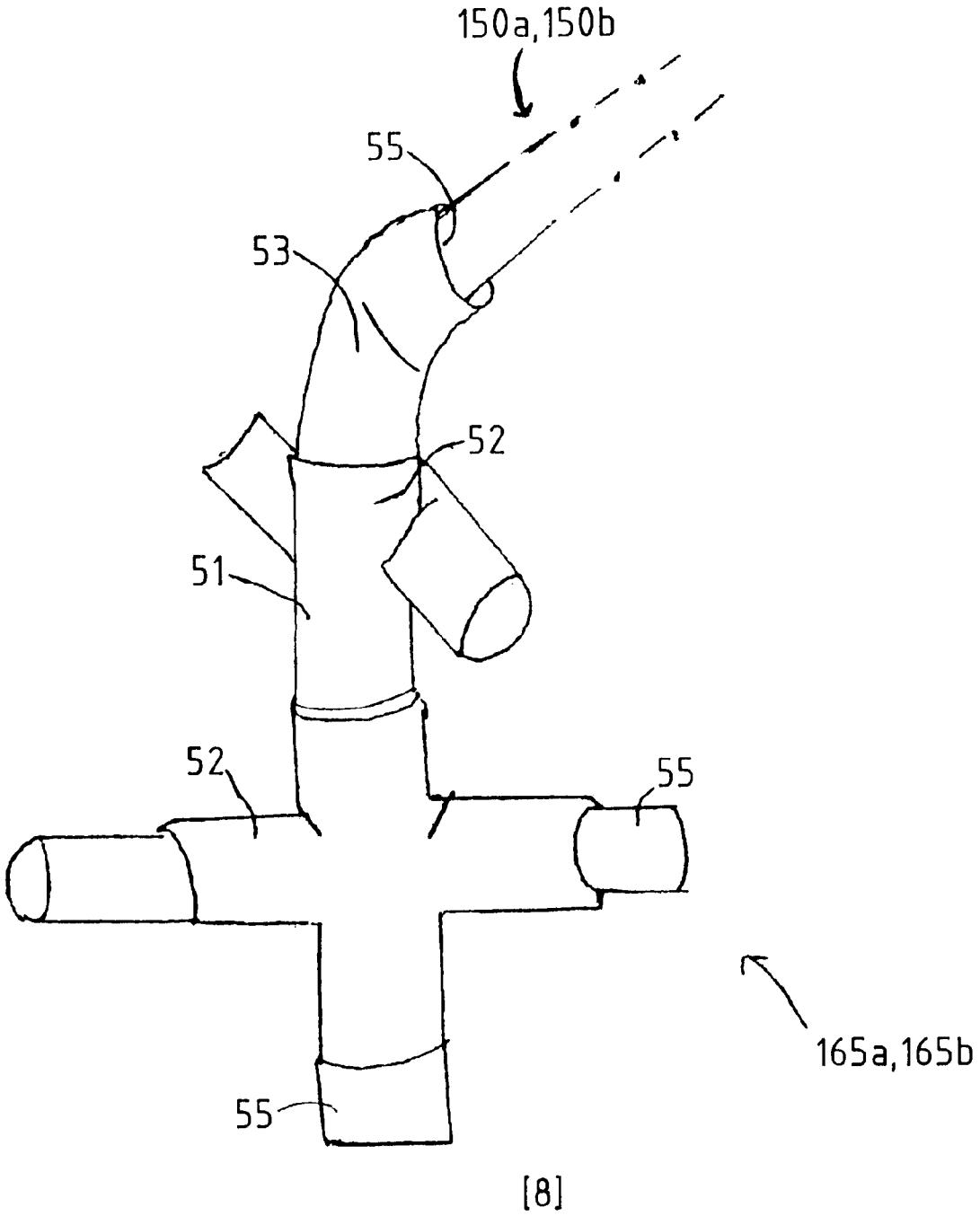
FIG. 23 illustrates an isolated lateral view of an angled leg attachment.

Referring now to FIG. 1 and FIG. 23, first leg attachment 165*a*, a second leg attachment 165*b*, or both, can be removably attached to each first distal leg end 150*c* or second distal leg end 150*d* respectively.

Each first leg attachment 165*a* or second leg attachment 165*b* preferably comprises a first lowermost four member cross connector 52 along a pipe segment 55, and which pipe segment 55 reversibly inserts into third central foot 155*a* or fourth central foot 155*b*. A second pipe segment 55 inserts into a second lowermost four member cross connector 52, which also encircles first pipe segment 55, and in a plane parallel to rigid horizontal support surface 8.

Each leg attachment 165*a*, 165*b* is useful for performing leg presses or as an additional foot rest.

Bunge Cords

Referring now to FIG. 15 each of first bunge cord 11*a* and second bunge cord 11*b* is approximately ½ inch in diameter in the preferred embodiment.

Each bunge cord 11*a*,11*b* further comprises a first hook 11*g* and a second hook 11*h* respectively(not seen in this view). In the filly assembled functional reclining multiuse exercise apparatus 100, each bunge cord 11*a*,11*b* maintains third slanted support pipe 500*f*, and leg attachments 165*a*, 165*b* rigidly aligned.

Bunge cords 11*a*,11*b* also resist forces which tend to disrupt the apparatus configuration during leg press exercises. Heavy duty rubber bands are satisfactory, but bunge cords are the preferred choice.

Adjustors and Pin Attachments

In the preferred embodiment, adjustors and pin attachments are the devices by which the functional reclining multiuse exercise apparatus 100 adapts to body size or exercise requirements.

First Angled Adjustor and Second Angled Adjustor

Figure 4:
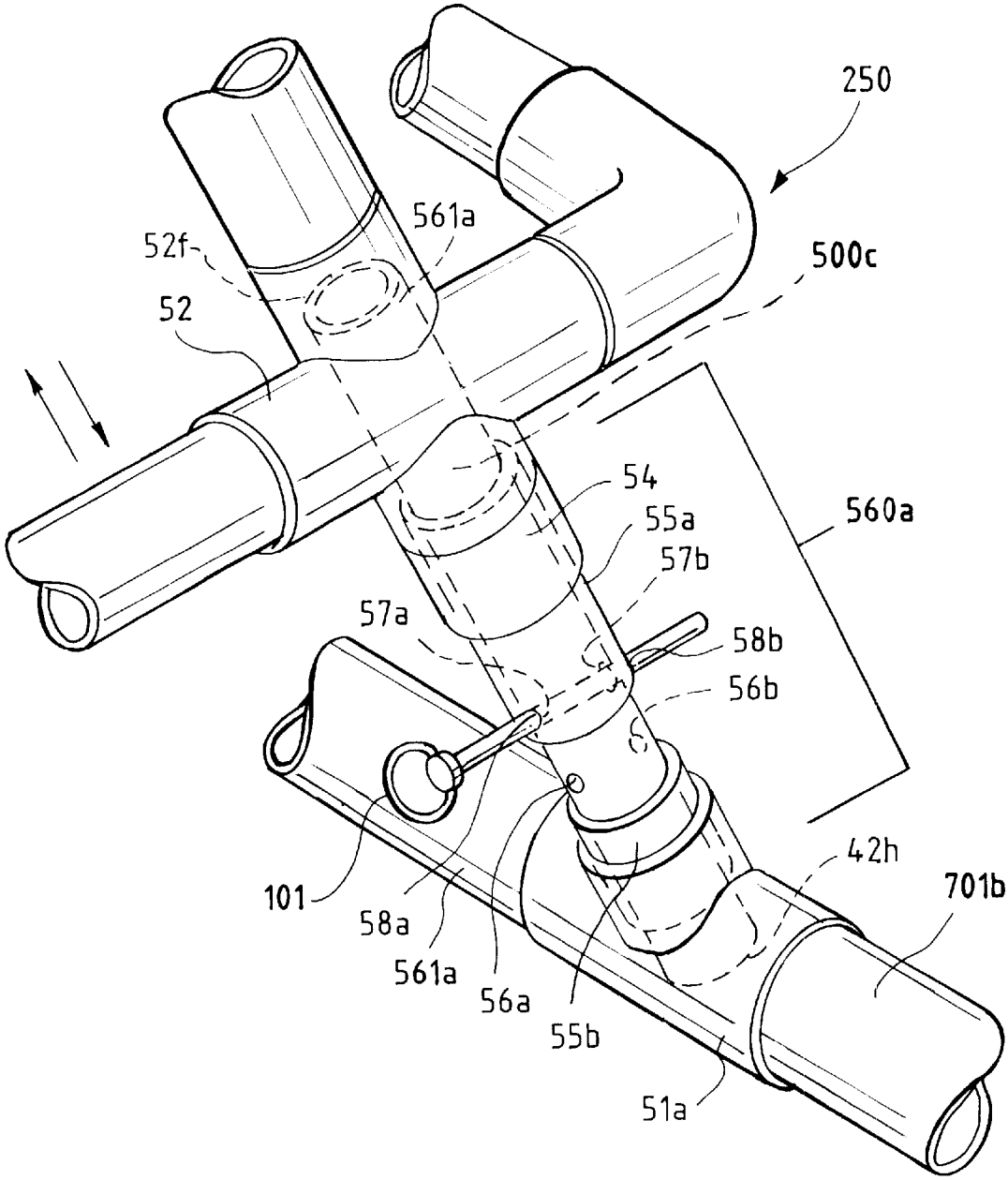
FIG. 4 illustrates a lateral view of a slanted adjustor and exposed adjustor bar comprising a third rotating slanted support pipe.

Referring now to FIG. 4, first angled adjustor 560*a* changes the position of elevated angled framework 200 and lower slanted framework 250 from rigid horizontal support surface 8.

Although FIG. 4 only depicts first angled adjustor 560*a*, the structure and function of second angled adjustor 560*b* is exactly the same.

Each first angled adjustor 560*a* and second angled adjustor 560*b* comprises a first slanted adjustor bar 561*a* and a second slanted adjustor bar 516*b* respectively. Each angled adjustor 560*a*, 560*b* also comprises an upper two end extension connector 54 into which each slanted adjustor bar 561*a*,561*b* slidably inserts in a male/female relationship.

In the preferred embodiment, each slanted adjustor bar 561*a*, 561*b* is permanently adhered at its lower end 42*h* within pipe segment 55*b*.

The upper two end extension connector 54 is adhered to an uppermost four member cross connector 52. P4 PVC cement is the adhesive of choice, described in detail infra.

As best seen in FIG. 4, each slanted adjustor bar 561*a*, 561*b* is of smaller diameter than lower pipe segment 55*b* and two-end extension connector 54. It is also of smaller diameter than upper pipe segment 55*a*, which is adhered immediately adjacent to each upper two-end extension connector 54. Each two end extension connector 54 in turn is permanently adhered to a four member cross connector 52. Each lower t-joint connector 51 protrudes upwardly from second transverse connecting bar 701*b*. Each adjustor bar 561*a*, 561*b* also comprises an upper end 52*f*.

Each slanted adjustor bar 561*a*, 561*b* comprises pinhole sets 57 and 56. The pinholes 56*a*, 56*b*, 57*a*, 57*b* of each pinhole set 56, 57 respectively are approximately 180 degrees apart along each slanted adjustor bar 561*a*, 561*b*. Please see in FIG. 4. One, two or more pinhole sets within each slanted adjustor bar 561*a*, 561*b* are within the scope of the invention.

However, they must be linearly and vertically aligned with respective members of other pinhole sets, and the two members of each pinhole set must be approximately 180 from each other along the same pipe circumference.

Pinholes 55 or 56 in each first and second angled adjustor bars 561*a*, 561*b* are approximately ½ inch apart in each linear vertical alignment.

Still referring to FIG. 4, upper pipe segment 55*a* comprises pinhole set 58. Each pinhole 58*a*, 58*b* of pinhole set 58 opposes the other along the same circumference of upper pipe segment 55*a*, and at an angle of approximately 180 degrees in the preferred embodiment. Pinhole set 58 is aligned along the same circumference as pinholes 57*a*,57*b*, or 56*a*, 56*b*, so if upper pipe segment 55*a* is manually elevated, pinholes 58*a*, 58*b* can congruently aligned with pinhole sets 57 or 56.

Attached four member cross-connector 52, upper two end extension connector 54, and upper pipe segment 55*a*, slidably receive each respective adjustor bar 561*a*, 561*b* in a male/female relationship. In the preferred embodiment, a change in position of elevated angled framework 200 occurs by manual alignment of pinhole set 56 or 57 in each first and second slanted adjustor bar 561*a*,561*b*, with pinhole set 58 in upper pipe segment 55*a*.

It is uppermost pipe segment 55*a*, two end extension connector 54, four member cross connector 52, and lower slanted framework 250 which move to align with pinholes 56, 57. Adjustor bars 561*a*, 561*b* remain immobile and firmly attached at bottom ends 42*h*. A metal pin 101 is then manually inserted through horizontally aligned pinholes 58*a*, 58*b*, 57*a*, 57*b*, or 58*a*, 58*b*, 56*a*, 56*b*, to mechanically retain slanted support pipes 500*c*, 500*d* in a predetermined higher or lower position.

To obtain this new predetermined vertical height, slanted support pipes 500*c* or 500*d* are raised until their respective pinhole sets 57,58 are congruent with the corresponding interiorly positioned first or second adjustor bar pinholes 55,56.

The user then manually slides a long metal pin 101 through both predetermined pinhole sets 55, 56, 57, 58 to mechanically hold slanted support pipes 500*c*, 500*d* rigid at a second predetermined position. Long metal pin 101 with a rounded tip 101*d* penetrates both four congruent pinholes 55/57 or 58/56 in each narrower adjustor bar within the wider surrounding pipe and two-end connector 54.

In the preferred embodiment, long metal pins 101 are sufficiently strong to withsand a person's weight, as well as apparatus 100. When the user changes to a new predetermined position, first and second adjustor bars 561*a*, 561*b* remain stationary. However, first slanted support pipe 500*c* and second slanted support pipe 500*d* are manually raised or lowered until appropriate pinholes 57,55 or 58,56 are congruently aligned, and held statically by long metal pin 101.

Long metal pins 101 are available from:

Crown Bolt, Inc.

Corritos Calif. 90703 and come in two types:

(a) eye bolt, 5/16 inch diameter.×four inch length; and (b) hitch pin, cotterless: 1/3" diameter×1 and 3/4 inch length and 1/4 inch diameter×three inch length.

Hitch pins, of 1/4 inch diameter×three inch length, are the preferred pins for apparatus 100.

Horizontal Attachments

Figure 3:
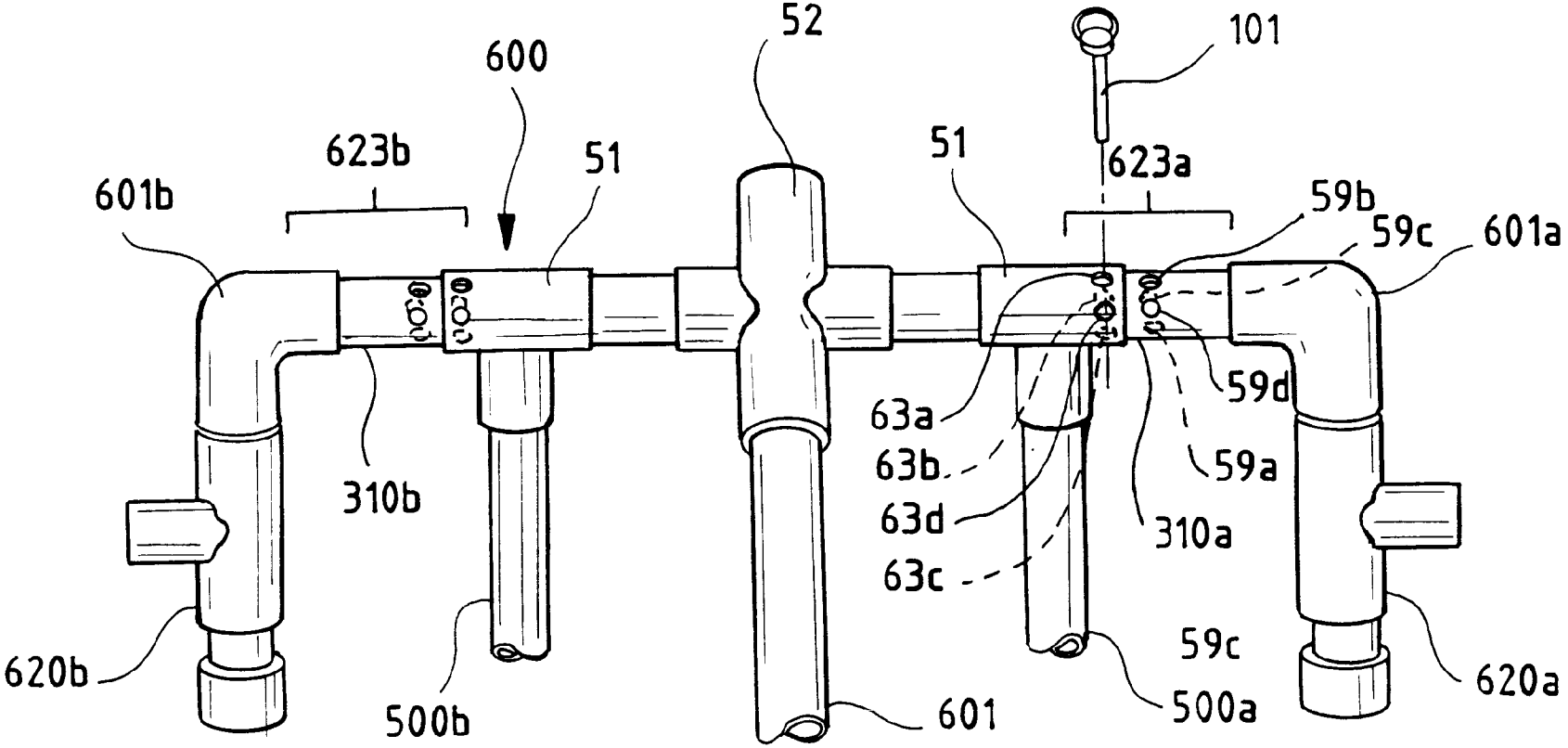
FIG. 3 illustrates an isolated lateral view of a first horizontal adjustor and exposed adjustor bar for a back support pipe.

Referring now to FIGS. 3 and 24, first back support bar end 621*a* and second back support bar end 621*b* each comprise a first horizontal pin attachment 623*a* or a second horizontal pin attachment 623*b* respectively. Each horizontal pin attachment 623*a*, 623*b* comprises a first horizontal adjustor bar 310*a* and a second horizontal adjustor bar 310*b* respectively, which are permanently adhered within two angled connectors 52. Each angled connector 52 in turn comprises each of first and second detachable downard extensions 620*a*, 620*b* respectively supra.

First horizontal adjustor bar 310*a* and second horizontal adjustor bar 310*b* each contain two horizontally oriented pinholes 59*a*, 59*b* and two vertically oriented pinholes 59*c*, 59*d*. Each pinhole 59*a*, 59*b*, 59*c*, 59*d*(generically pinholes 59) is approximately 90 degrees from each adjoining pinhole around the same circumference of each adjustor bar 310*a*, 301*b* respectively. Correspondingly, each t-joint connector 51, which adjoins each angled connector 53 and into which an adjustor bar 310*a*,310*b* reversibly inserts, has pinholes 63*a*, 63*b*, 63*c*, 63*d*(generally pinholes 63). These pinholes 63 are congruent with adjustor bar pinholes 59 when each adjustor bar 310*a* or 310*b* is inserted into its respective t-joint connector 51.

A long metal pin 101 is inserted either horizontally or vertically through aligned pinholes within each t-joint connector 51 and adjustor bars 310*a*, 310*b* respectively. Horizontal pin attachments 623*a*,623*b* are used to remove or reattach downwardly protruding pipes 620*a*,620*b* to back support pipe 600. The two sets of pinholes allow two different attached positions for downwardly protruding pipes 620*a*,620*b*.

Fifth Adjustor and Backstop for Adjustable Support Pipe

Figures 5, 6A:
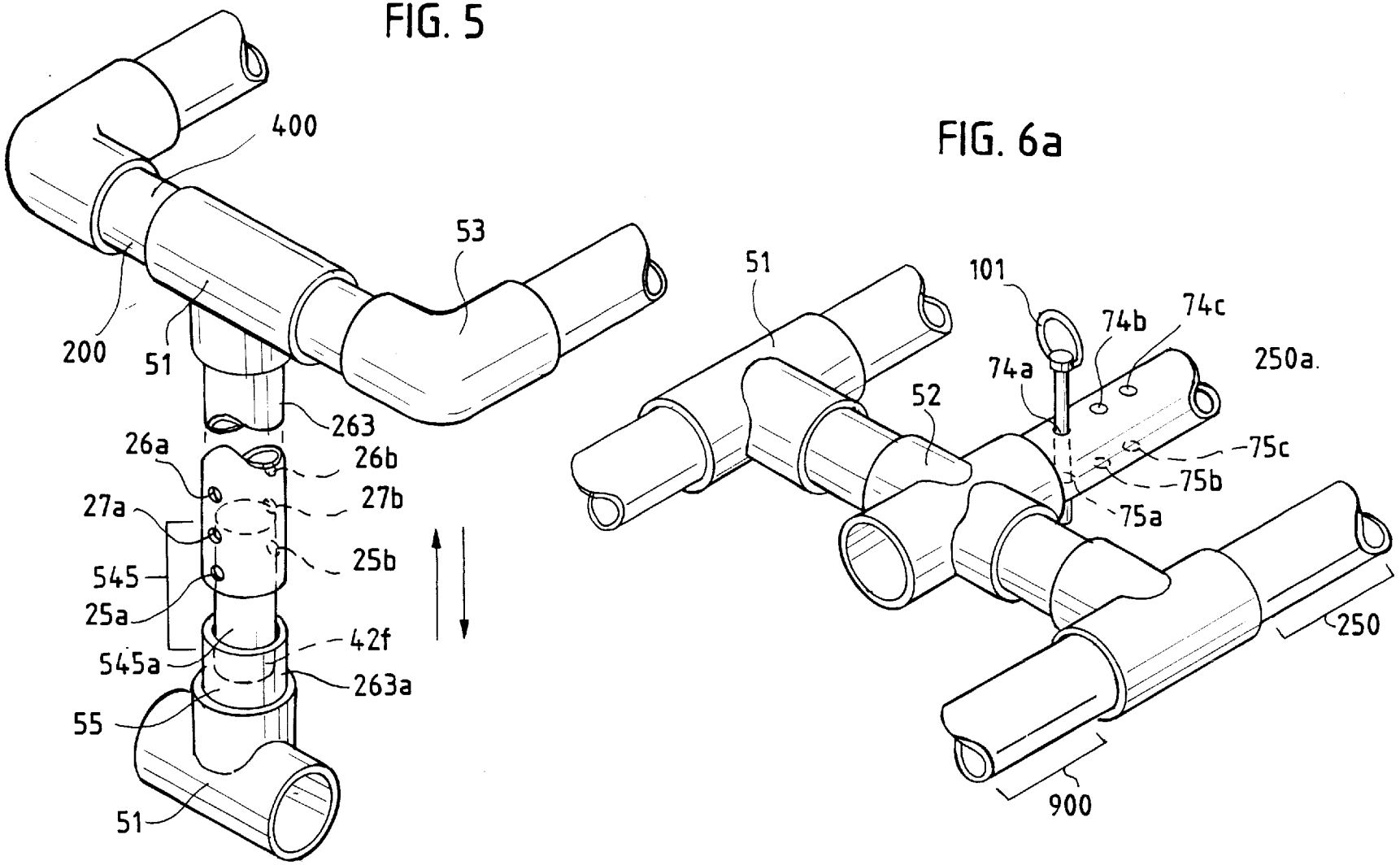
FIG. 5 illustrates in lateral closeup view an adjustor with exposed adjustor bar on rotating slanted support pipe.
FIG. 6*a* illustrates a top plan view of a pin attachment on central pipe segment of lower attachment.

Referring now to FIGS. 5, 9 and 21, fifth adjustor 545 is located within lower disattached end 263*a* of adjustable support pipe 263 in the preferred embodiment. Fifth adjustor bar 545*a* has a lower circular end 42*f*, which is permanently adhered within a pipe segment 55 with P4 PVC cement. Each pipe segment 55 in turn is permanently adhered within a single t-joint connector 51 at lower disattached end 263*a*. As noted supra, this single t-joint connector 51 contacts the upper surface of central pipe segment 206*b*. Pipe segment 55, together with fifth adjustor 545, raises or lowers the angle of upper elevated framework 200 to flat rigid horizontal supporting surface 8. Pipe segment 55 and fifth adjustor 545 also contribute a shock absorber effect.

Fifth adjustor 545 can adjust the height and angle of elevated angled framework 200.

Figure 8:
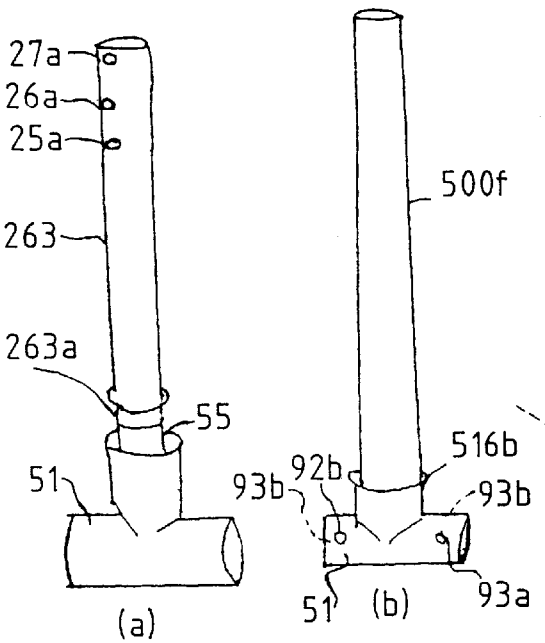
FIG. 8*a* illustrates an isolated lateral view of third rotating slanted support pipe.
FIG. 8*b* illustrates an isolated lateral view of adjustable support pipe.

Referring now to FIGS. 5 and 8*a*, fifth adjustor bar 545*a* comprises at least one pair of linearly aligned pinholes 25*a*, 25*b*. These pair of pinholes 25*a*, 25*b* can be aligned congruently with linearly aligned corresponding pinholes 26*a*, 26*b* in adjustable support pipe 263. To shorten adjustable support pipe 263, fifth adjustor bar 545*a* is moved upwardly within adjustable slanted support pipe 263 until two pinholes 25*a*,25*b*, 26*a*,26*b* are congruent with each other.

The user then inserts a long metal pin 101 through these pinholds for a shorter or longer dimension of adjustable supuport pipe 263.

Figure 17:
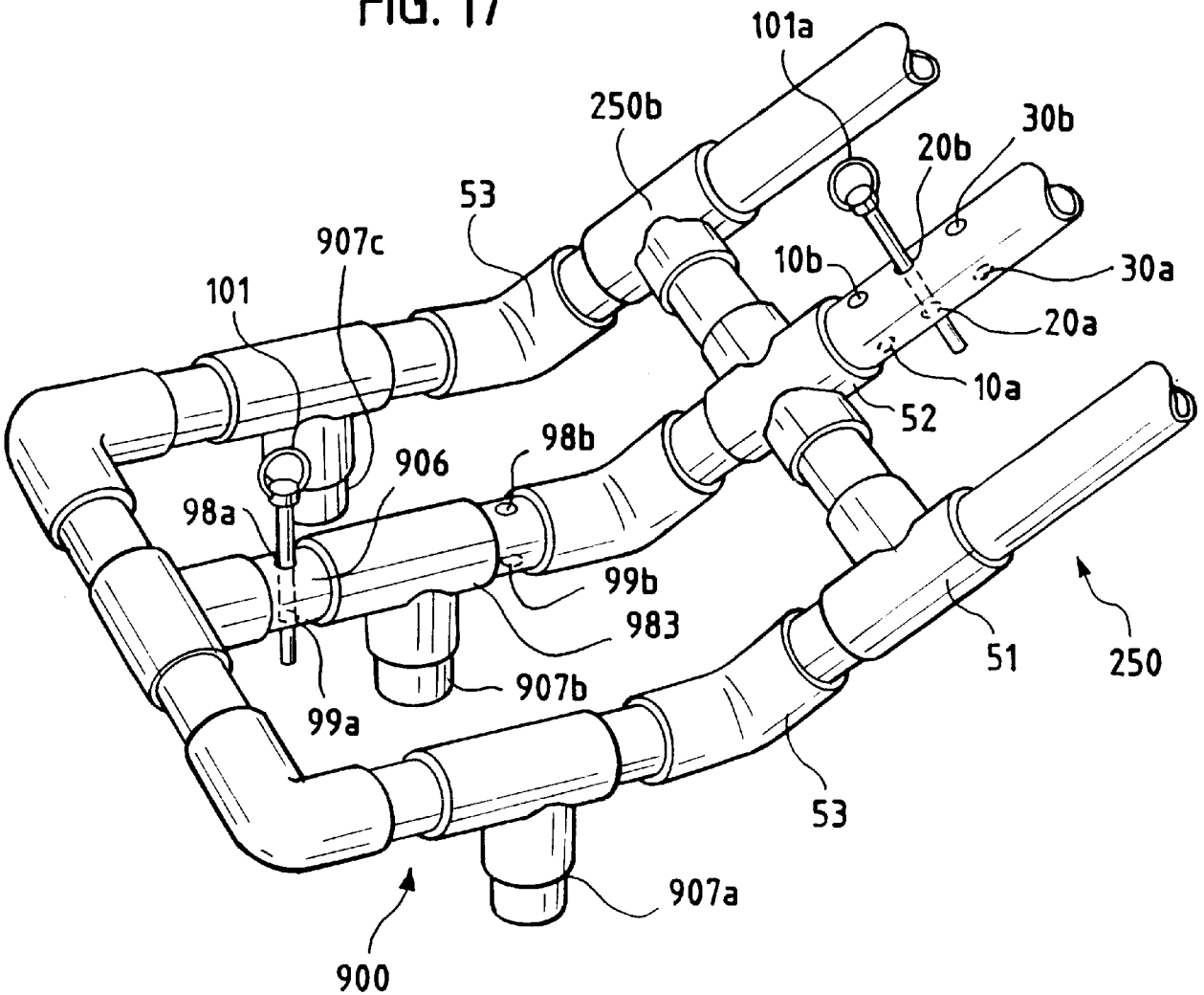
FIG. 17 is an isolated partial upper plan view of lower attachment with pin attachment and three supporting feet.

Referring now to FIG. 17, cedntral pipe segment 250*b* comprises at least three longitudinal linearly aligned pinhole pairs: 10*a*,10*b*; 20*a*,20*b*; and 30*a*,30*b*. Pinholes 10*a*, 20*a* and 30*a* are approximately 180 degrees apart from pinholes 10*b*,20*b*,30*b* along central pipe segment 250*b*. All pinholes 10*a*,10*b*,20*a*,20*b*,30*a*, 30*b* are proximal to lower end 250*e* of lower slanted assembly 250. In this manner adjustable support pipe 263 can be manually moved along central pipe segment 250 to raise lower end 400, as well as leg attachments 150*a*, 150*b* on rotating support pipe 500*f*.

While supported by a larger metal pin 101*a* inserting through a predetermined set of pinholes, such as 10*a*, 10*b*, larger metal pin 101*a* acs as a backstop for the new position of third adjustable support pipe 263.

Leg/Pin Attachment for Third Rotating Slanted Support Pipe

Figure 13:
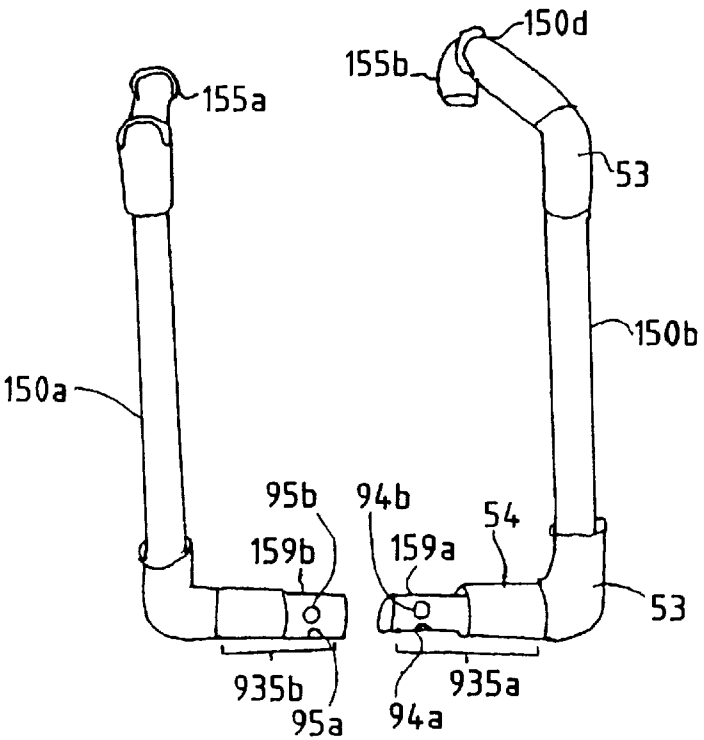
FIG. 13 illustrates in top plan isolated view, first angled leg and second angled leg.

Referring now to FIGS. 9, 13, and 20, rotating slanted support pipe 500*f* is directly attached at its lower end 516*b*, to first angled leg 150*a* and second angled leg 150*b* by pin/leg attachments. As seen in FIG. 13, there is a first/leg pin attachment 935*a*, and a second leg/pin attachment 935*b* respectively.

As seen in FIG. 8*b*, lower end 516*b* comprises a t-joint connector 51, which in turn comprises a set of pinholes 92*a*, 92*b* along opening 51*a*, and pinholes 93*a*,93*b* along opening

51*b* in horizontal alighnment. Each set of pinholes are approximately 180 degrees apart.

Each first angled leg proximal end 158*a* and second angled leg proximal end 158*b* comprises a first leg/pin attachment 935*a* and a second leg/pin attachment 935*b* respectively. Adjustor bars 159*a,* 159*b* respectively, are each permanently adhered by their distal ends into a two-end extension connector 54. Proximal ends 159*c,* 159*d* reversibly insert into a respective tjoint connector 51, with connector 51 attached to rotating slanted support pipe 500*f*. Each adjustor bar 159*a,* 159*b* comprises two opposing pinholes at approximately 180 degrees to each other.

Pinholes 92*a,*92*b* and 93*a,* 93*b* within adjustor pipe 159*a* or 159*b* respectively are congruent with pinholes 94*a,*94*b,* and 95*a,* 95*b* respectively within t-joint connector 51. This congruency occurs whenever each disattached first angled leg 150*a,* or disattached second angled leg, or both, are inserted into either opposing open end 51*c,* 51*d* of t-joint connector 51.

Long metal pins 101 are then each inserted through congruent sets of pinholes to hold first and second angled legs 150, 150*b* within t-joint connector 51 of third slanted support pipe 500*f*. Using this leg/pin attachment, a user can manually remove or attach angled legs 150*a,* 150*b*.

Assembly Pin Attachment

Figure 6B:
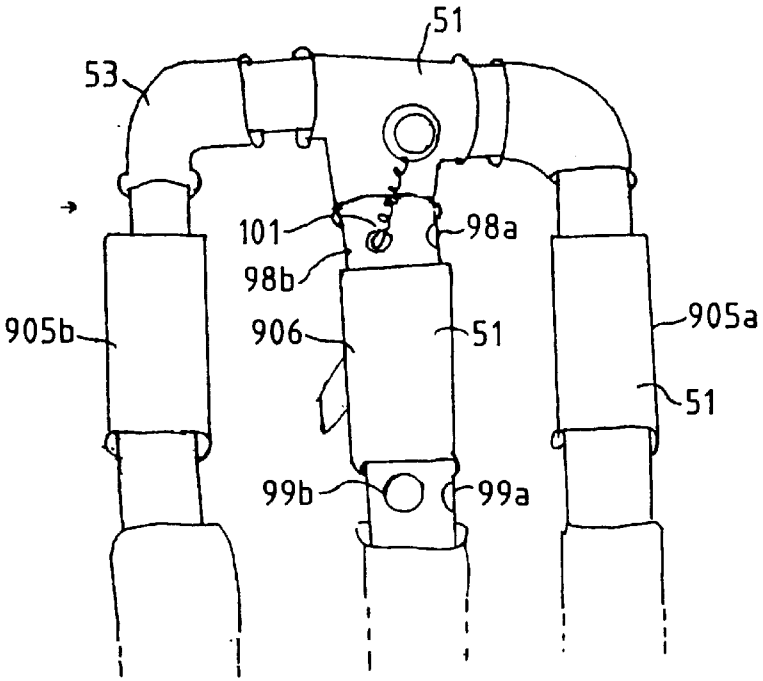
FIG. 6*b* illustrates a lateral closeup view of the pin attachment comprising central pipe of lower attachment, framework.

Referring now to FIGS. 6*b* and 17, lower attachment adjustor 983 comprises central segment 906 of lower attached assembly 900.

Lower attachment adjustor 983 comprises two sets of aligned pinholes 98*a,*98*b,* 99*a,* 99*b,* on either side of t-joint connector 51. Pinholes 98*a,* 98*b* are at approximately 180 degrees to each other along central segment 906, as are pinholes 99*a,*99*b*. A long metal pin 101 serves as a backstop for the position of angled legs 150*a,*150*b,* when inserted through pinholes 98*a,* 99*b,* or 99*a,* 99*b*. This backstop is created by long metal pin 101 supporting rotating support pipe 500*f* along t-joint connector 51 in at least two predetermined positions.

Pipe Construction and Materials

The functional reclining multipurpose exercise apparatus 100 comprises primarily hollow cylindrical polyvinychloride(PVC)pipe in the preferred embodiment. Elevated angled framework 200 and lower slanted framework 250 in particular are preferably comprised of polyvinylchloride (PVC) pipe.

Horizontal or slanted support pipes are preferably made from 1 and ¼" diameter PVC pipe, while vertical support pipes are preferably made from ¾" diameter PVC pipe. Pipes are preferably cylindrical in shape, although other shapes are also acceptable. In the preferred embodiment each PVC pipe diameter should be such that it is reversibly removable from PVC connector units, described infra in detail.

PVC pipes, which are preferably approximately one and one-fourth inch in diameter, comprise elevated angled framework 200. However, diameters of different pipes may range from approximately 1 and ½ inches to approximately 1(one inch).

All connectors and cylindrical pipes are preferably made of the same material, most preferably polyvinylchloride (PVC). However, other materials of appropriate strength and rigidity are also within the scope of the functional reclining multiuse exercise apparatus 100. For example, plastic, aluminum, stainless steel and wood are satisfactory. Pipes are preferably hollow in the preferred embodiment.

However, such cylindrical and other shaped pipes need not be hollow, if the pipes are not cumbersome and cost-prohibitive.

Polyvinylchloride(PVC) piping for the preferred embodiment is available from:

Bristol Pipe
P.O. Box 609
503 East Vistula St.
Bristol, Ind. 46507
1-800-348-7671

Removable Framework Reclining Pads and Removable Framework Sitting Pads

Figure 12:
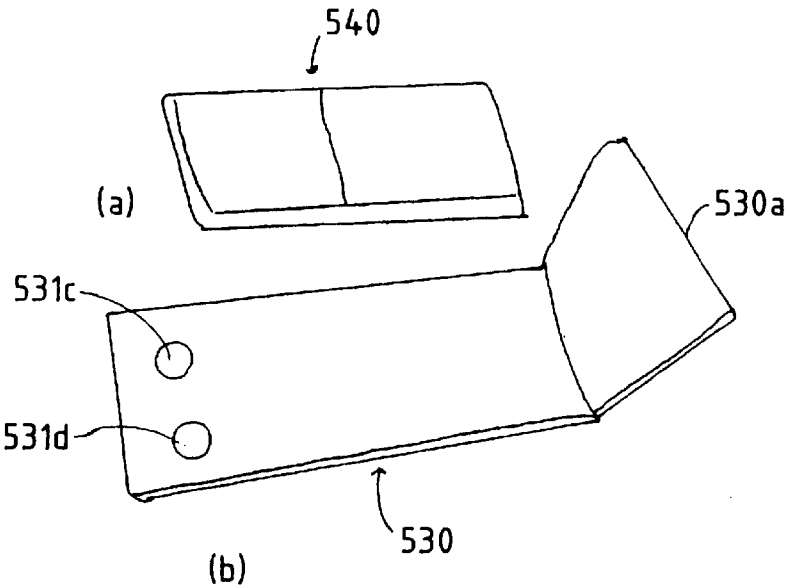
FIG. 12*a* illustrates removable framework sitting pad and removable framework reclining pad in top plan isolated view.
FIG. 12*b* illustrates removable framework reclining pad in isolated view.

Referring now to FIG. 12, in the preferred embodiment the functional reclining multiuse exercise apparatus 100 comprises a removable framework reclining pad 530 and/or removable framework sitting pad 540.

In the preferred embodiment, removable framework reclining pad 530 and framework sitting pad 560 are made of plywood strips. Both removable framework reclining pad 530 and removable framework sitting pad 540 are also comprised of approximately a one(1) inch thickness of black leather covering and cotton batting.

Plywood strips are approximately ¼ inch in width and approximately ¼ inch in thickness. Both removable framework reclining pad 530 and framework sitting pad 560 are custom made by:

J. Upholstering
Fabrics & Furniture
4093 West Irving Park
Chicago, Ill.

The length of the removable framework reclining pad 530 is approximately 34 inches, the width is approximately 14 inches, and its thickness is approximately one and one/half inches. In the preferred embodiment, removable framework reclining pad 530 has an integral angled extension 530*a*.

Removable framework sitting pad 540 is made similarly to removable framework reclining pad 530 by a method well known in this particular industry. Integral angled extension 530*a* has the same width and thickness as reclining framework pad 530, but is approximately ten and one-half inches in length.

Removable framework sitting pad 540 is approximately 25 inches in length, approximately 10 inches in width and approximately two and one-half(2 and ½) inches in thickness.

For use, removable framework reclining pad 530 is placed upon upper surface 200*a* of upper elevated framework 200, with extension 530*a* directly over bend 236 in elevated angled framework 200.

Use

Figure 26:
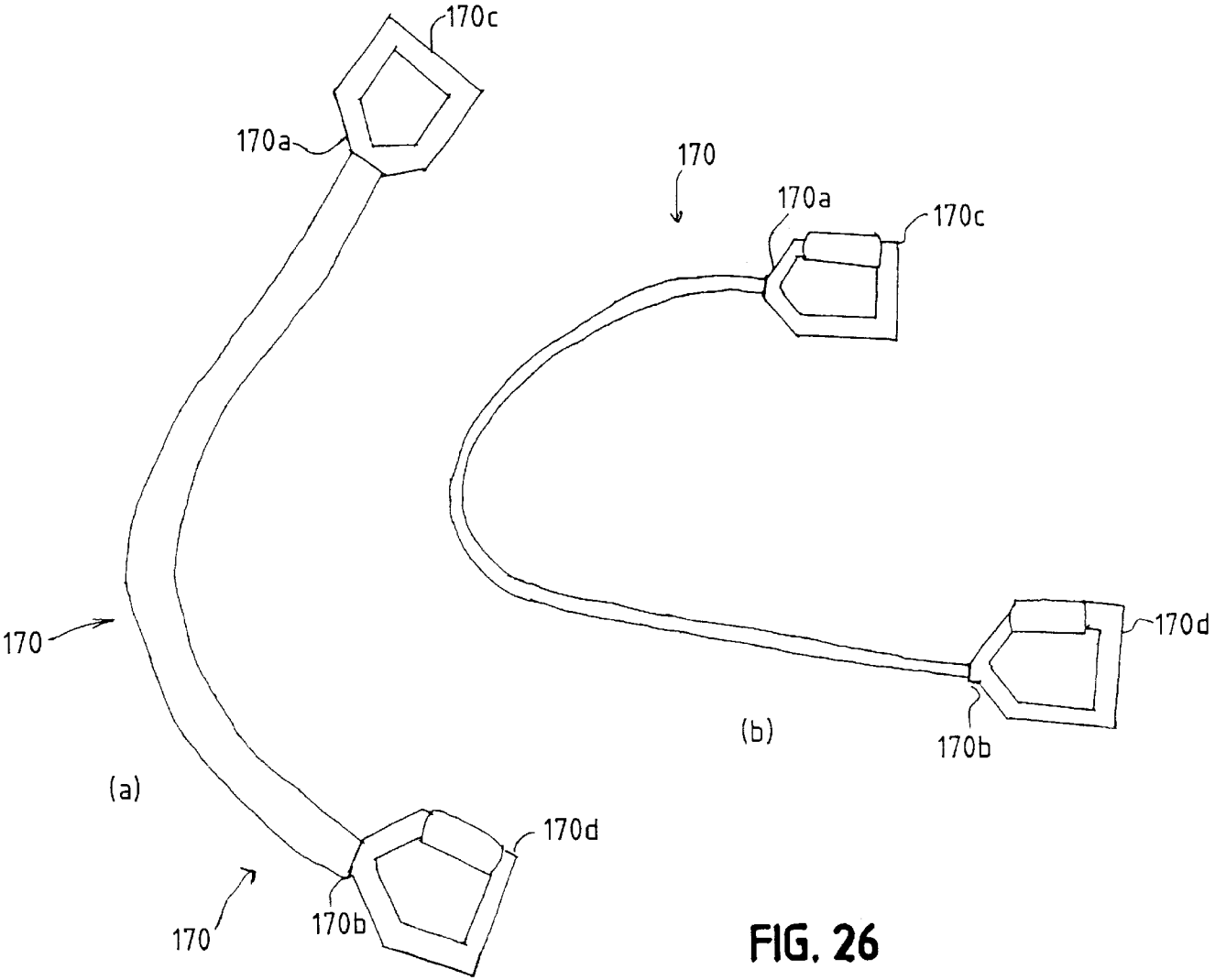
FIG. 26*a* illustrates an isolated yellow exercise stretch band.
FIG. 26*b* illustrates an isolated black exercise stretch band.

Referring now to FIGS. 26*a* and 26*b,* the primary resistance for developing strength with the functional reclining multiuse exercise apparatus 100 is with exercise stretch bands 170.

Use of the functional multiuse reclining exercising apparatus 100 is straightforward for numerous therapeutically beneficial exercises in a home or other small space environment. The functional reclining multi-use exercise apparatus 100 is preferably used with exercise stretch bands 170. However, free hand weights and large diameter generic rubber bands are also acceptable.

The functional reclining multi-use exercise apparatus 100 is adaptable to the following exercises: rowing; chest press, chest flies, shoulder raises, shoulder presses, bicep curls, tricep extension, upright row, back extension, leg extension, leg curls, hip extensions, adduction, abduction, calf raises, and abdominal crunches. These exercises are familiar to those in the physical training and physical therapy arts.

Exercise stretch bands 170 are available from any major sports equipment, medical supply house or physical therapy distribution outlet. One such supplier is SPRI Products, Inc., at 1-800-222-7774, 1026 Campus Drive, Mundelein, Ill. 60030. Each stretch exercise band 170 has a handle 170*c,* 170*d* at its first end 170*a* and its second end 170*b* respectively. The preferred exercise stretch bands 170 are available in the following colors: yellow, blue, green, red and black.

Each colored exercise stretch band 170 has a specific tension or resistance. For example, as seen in FIG. 26*a,* a black exercise stretch band has the most resistance and the thickest diameter. A black exercise stretch band consequently gives the most rigorous workout, as is well known in this particular art. As illustrated in FIG. 26*b,* yellow offers the least resistance to muscle movement and has the smallest diameter.

When using the functional multi-use exercise apparatus 100, a preselected exercise stretch band 170 is slipped onto a selected portion. For example, for chest flies and chest presses, a blue stretch exercise band 170 can be looped around a four member cross connector 52 which comprises chain support bar 850. This blue stretch exercise band 170 is usefull for upright rows and to stretch upper back muscles while the user reclines upon elevated angled framework 200.

The user's decision on exactly where and how to loop exercise stretch bands 170 around the functional reclining multiuse exercise apparatus 100 depends upon the specific exercise. For example, for a shoulder press exercise, a stretch band 170 must loop under the angle of lower attached assembly 900. Moreover, there are only two kinds of movement when using the exercise apparatus 100: push and pull techniques. Each stretch exercise band 170 is looped beneath the exercise apparatus 100 when performing a push exercise routine such: as chest flies, chest presses, shoulder presses, shoulder raises, and tricep extensions.

A stretch exercise band 170 can also be looped around chain support pipe 850 at any adjoining four member cross connectors 52 for a pulling exercise. This approach is advantageous whenever the user is seated or reclining on elevated angled framework 200. In sum, a stretch exercise band 170 can be looped anywhere along the exercise apparatus 100, as long as the appropriate tension is created. A chest press is a good example of a push technique exercise.

As a second example a yellow stretch exercise band 170 can be looped around upwardly protruding sections 718*a,* 718*b* for hip extensions and leg curls. The user can also loop a green stretch exercise band 170 under upwardly protruding sections 718*a,* 718*b* and anterior to first and second vertical support pipes 500*a,* 500*b,* to perform abdominal muscle exercises.

As a fourth example, a user can loop a red stretch exercise band 170 beneath each extension 706*a,* 706*b* along second transverse connecting bar 701*b.* A last example is a yellow stretch exercise band 170 looped under ends 704*a,* 704*b* to perform back extensions, shoulder presses and muscle extensions.

These above examples with bands of specific resistances are only examples and in no way limit use of the apparatus 100. This means that bands of different resistances can also be positioned upon the apparatus 100 in these same looped positions or other positions, as the user considers appropriate.

For chest flies and chest presses, resistance is felt when both hands are brought together or the arms are fullly extended anterior to the chest. The tension decreases when both arms are brought back to a flexed position or the hands are returned to the starting point of the exercise routine(ie, hands next to pectorals).

The only difference between chest flies and chest presses is the manner in which the user's hands join in an extended position of the elbow. When the palms are brought together facing each other, this is a chest fly. When the hands are in a pronated position, this constitutes a chest press. These exercises are all generally known in the physical therapy, sports training art.

Free weights are used with the functional reclining multiuse exercise apparatus with the following exercises: chest press, chest flies, shoulder press, shoulder raise, bicep curls, tricep extension, leg press and upright row. For example, dumbbells(which are the free weights) are used in chest press exercises instead of stretch bands 170. During chest presses, the user reclines and holds of a pair dumbbells in each hand. Using these dumbbells instead of stretch bands 170 in chest press exercises generates an up/down movement above the user's chest. With a front shoulder raise, the user sits on the lower portion of reclining pad 530 and raises one arm a holding one pair of dumbbells above his knees and at shoulder length.

Figure 14A:
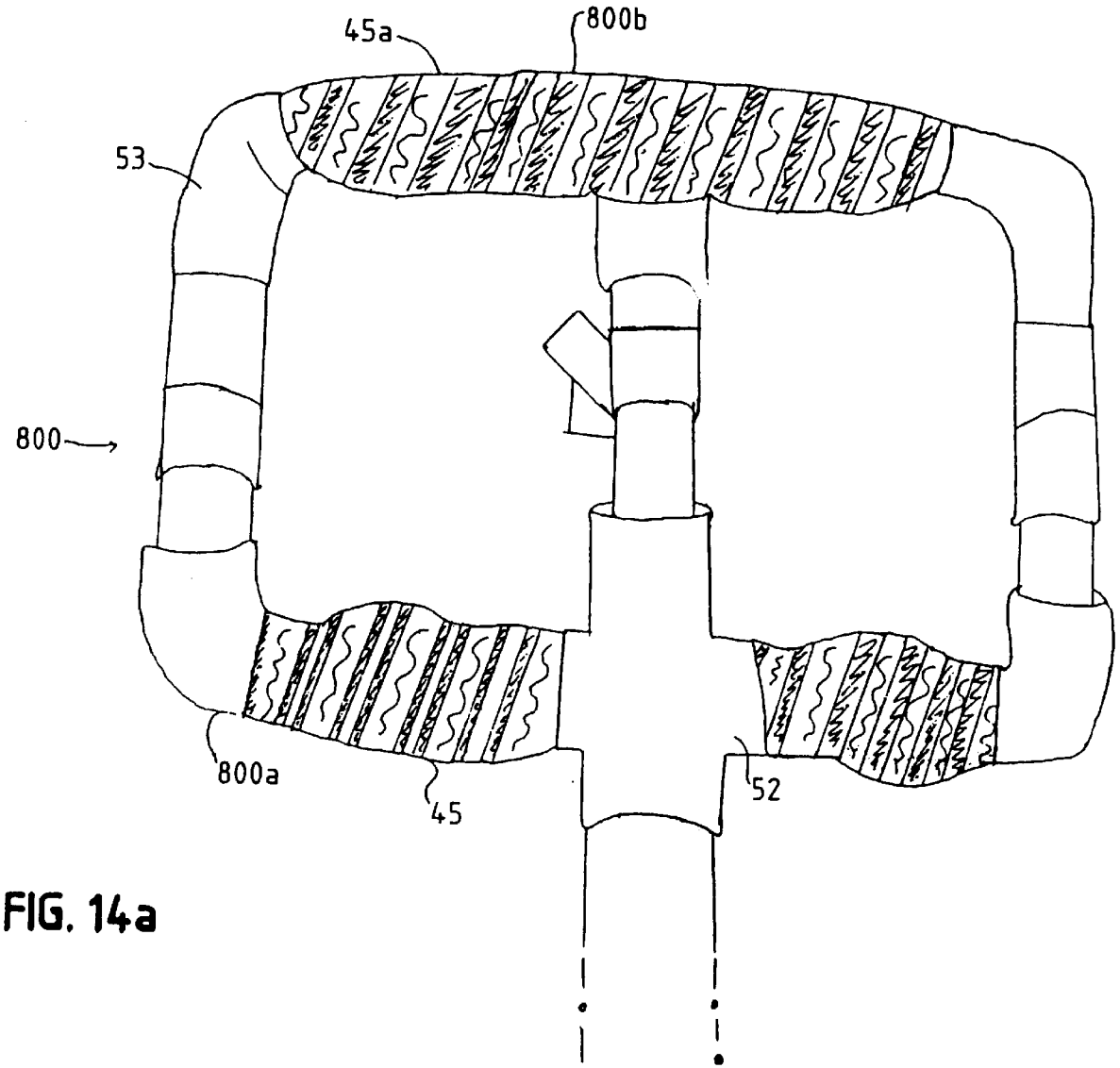
FIG. 14*a* illustrates a partial upper plan isolated view of sponge pads on handle attachment.
Figure 14B:
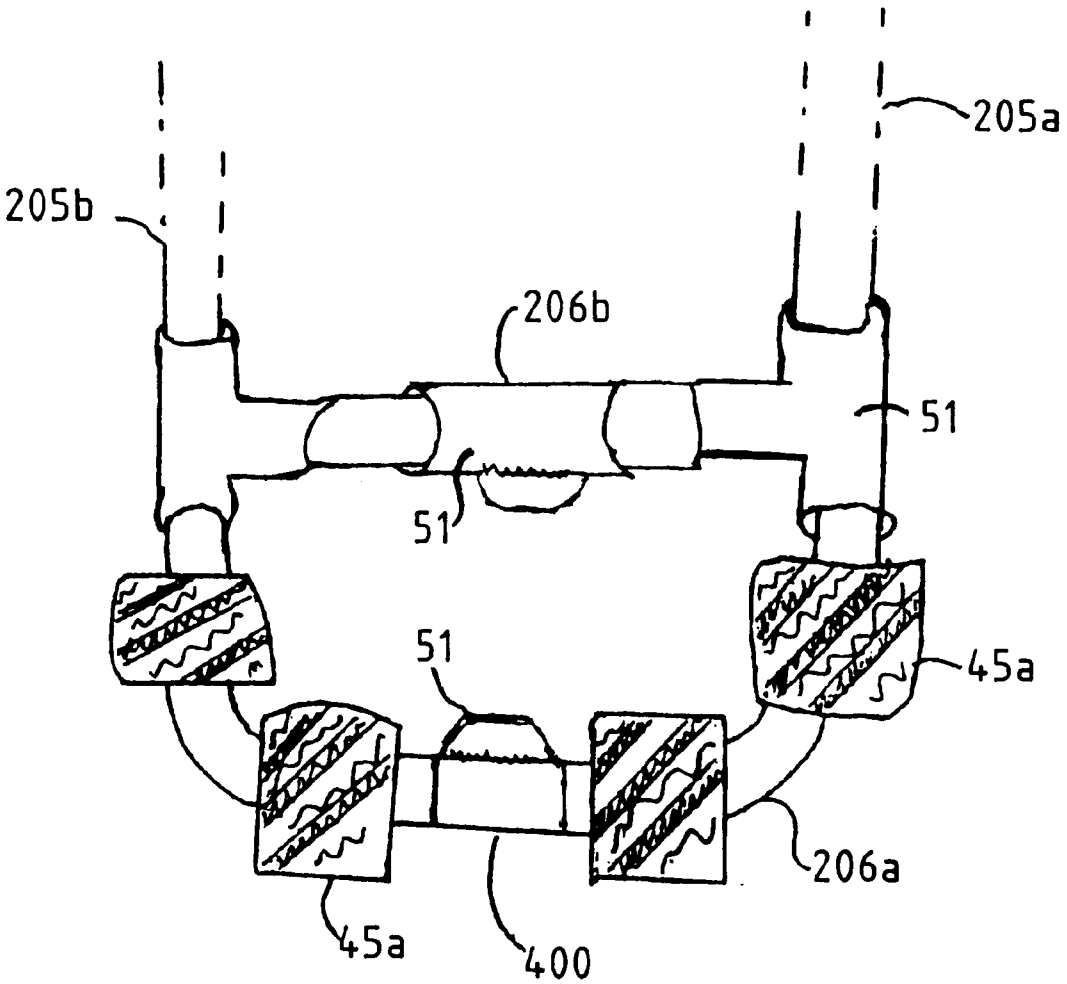
FIG. 14*b* illustrates a partial upper plan isolated view of sponge pads on lower end of elevated angled framework.

As seen in FIGS. 14*a* and 14*b,* for increased comfort the functional reclining multiuse exercise apparatus 100 also comprises soft sponge strips 45*a.* Sponge strips 45*a* are attached to high use physical contact areas such as handle segment 800.

The same is true for lower end 400 of elevated angled framework 200. Layered tape 45*b* is preferably applied to horizontal leg support bar 855. Please see FIG. 10*a.*

Connectors

Referring now to FIGS. 16*a,* 16*b,* 16*c* and 16*d,* the functional reclining multiuse exercise apparatus 100 comprises numerous connectors along each pipe or bar in the preferred embodiment. These connectors comprise rigid polyvinylchloride cylindrical connectors in the preferred embodiment including: t-joint connectors 51, angled connectors 53, four member cross connectors 52, and two-end connectors 54.

Each of these connectors comprises at least two openings 44 which hold, in a female relation, another end portion of a pipe or adjustor bar. For example, each T-joint connector 51 is frictionally held or permanently adhered in a predetermined location on base 200 or upon other components.

In the preferred embodiment, prefabricated connectors as well as other connectors and fittings for polyvinylchloride pipe construction are available from:

NIBCO Hardware Market
1516 Middlebury
Elkhart, Ind. 46515-1167
Phone: 219-295-b 3305

Connectors can also be made of aluminum, other light metals, plastics with sufficient rigidity and strength, or other appropriate materials. In the preferred embodiment, t-joint connectors 51 are approximately four inches to six inches in length and approximately 1 and ½ inches in diameter. However, other lengths and diameters of connectors are also satisfactory.

Each prefabricated angled connector 53 has an angle of approximately 45 degrees at its midpoint. As seen in FIG. 20, angled connectors 53 are particularly appropriate for assembly of first angled leg 150*a* and second angled leg 150*b.*

Each prefabricated angled connector 53 has an angle of approximately 60 degrees at its midpoint. As seen in FIG. 20, angled connectors 53 are particularly appropriate for assembly of first angled leg 150*a* and second angled leg 150*b.* The angled connectors 53 for angled legs 150*a,* 150*b* are preferrably approximately 60 degrees.

Figure 10:
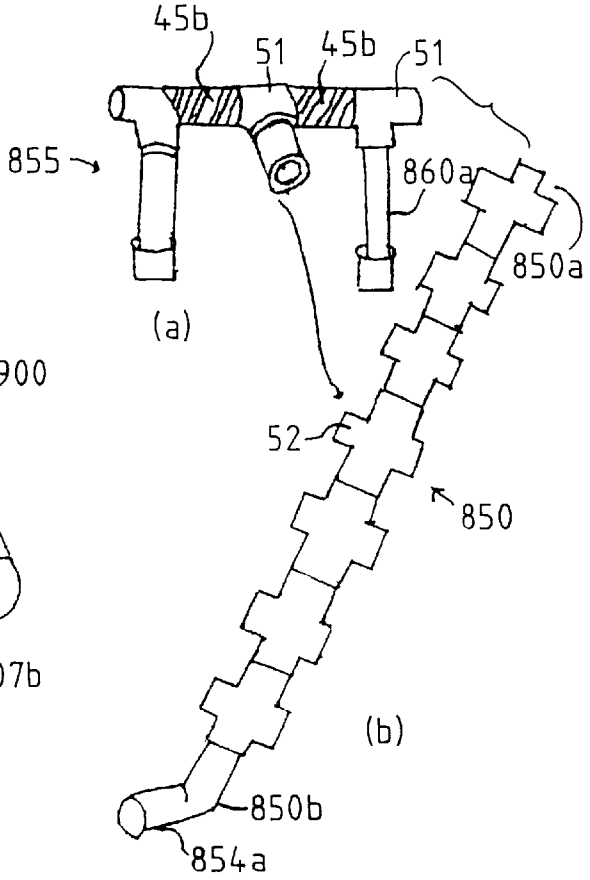
FIG. 10*a* illustrates horizontal leg support bar in an isolated view.
FIG. 10*b* illustrates an isolated chain support bar.

As seen in FIG. 10, four member(cross) connectors 52 are most suitable for horizontal and vertical attachments, as are as two-end connectors 54. Preferred use of these connectors are labeled throughout the attached drawings.

Assembly and Color Coding

Assembly or disassembly of the functional multiuse exercise apparatus 100 only requires a few minutes of manual adjustment.

Color Coding

This feature is possible in part because of the color coded components 90. The user matches identically color coded bands at the ends of individual pipes and bars to connectors.

The preferred embodiment incorporates the following color code:

Red tape color banding is 91

Black tape color banding is 92;

Blue tape color banding is 93;

Green tape color banding is 94; and

Brown tape color banding is 95.

For example, in the preferred embodiment, there are brown bands 95 upon vertical support pipes 500*a,* 500*b,* and corresponding brown bands 95 upon the protruding pipes into which vertical support pipes 500*a,* 500*b* insert. As another example, green bands 94 encircle second transverse connecting pipe 701*b* to indicate where slanted support pipes 500*c,* 500*d* insert for assembly(also green bands 94) for elevated angled framework and lower slanted framework.

Assembly of Subparts

There are numerous assembly points within the apparatus 100. FIG. 11 illustrates one assembly point: that of the reversible insertion of bracing pipe 860 to chain support pipe 850. As seen in FIG. 20, each first angled leg 150*a* and second angled leg 150*b* is easily removed or attached to the remainder of the apparatus 100 by one t-joint connector 51 on third rotating slanted support pipe 500*f* (at point C).

Figure 19:
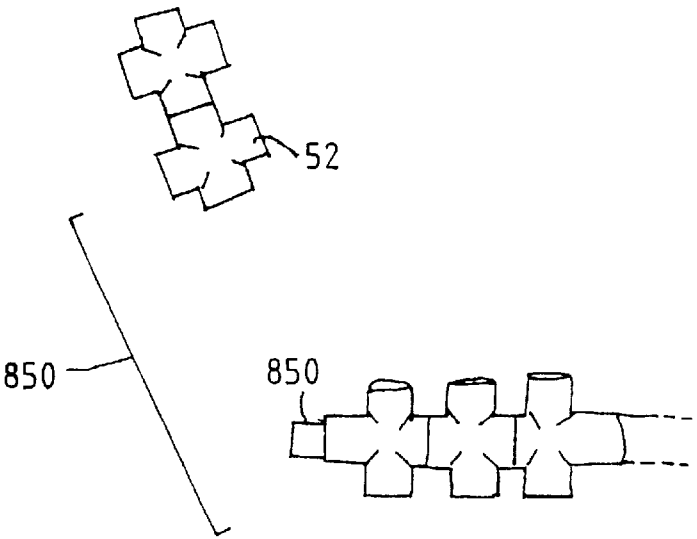
FIG. 19 is an isolated view of an exposed chain support pipe within adjoining four member cross connectors.
Figure 22:
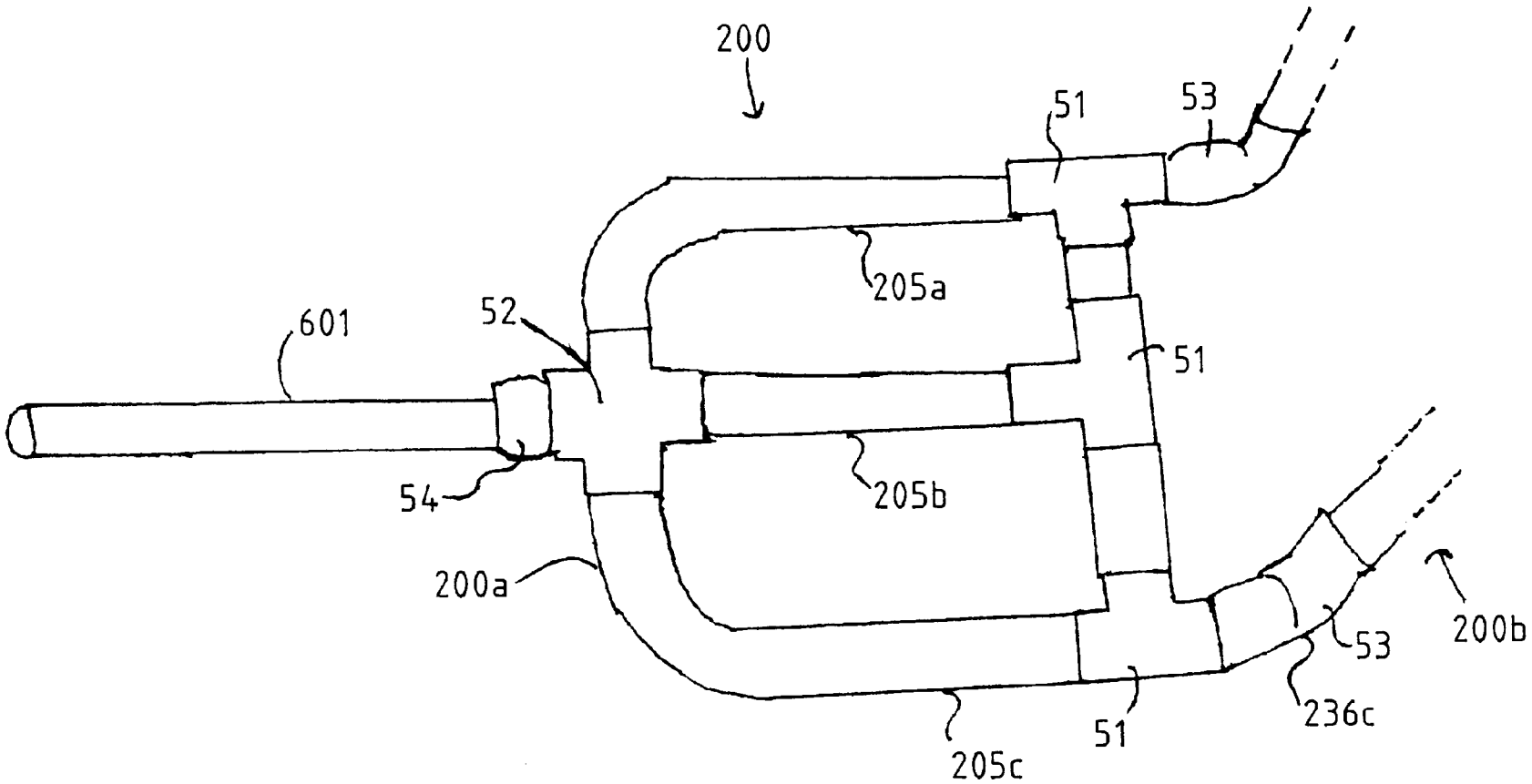
FIG. 22 illustrates the isolated partial plan view of elevated angled framework with an elongated connecting pipe.

Referring now to FIG. 22, discontinuous base 700 is attachable by first and second perpendicular pieces 702*a* and 702*b* respectively. FIGS. 11 and 19 illustrate the assembly of horizontal leg support bar 855 to chain support bar 850. FIG. 22 illustrates elongated connecting pipe 601, which can directly connect to: handle attachment 800; back support bar 600 and chain support pipe 850. These examples do not limit the other assembly points in the apparatus, and which are easily found in my assembly kit.

P4 PVC Cement

To permanently attach connectors and pipes into different components, P4 PVC cement is the adhesive of choice in the preferred embodiment. P4 PVC cement is applied to four-member cross connetors 52, t-joint connectors 51, angled connectors 53 and two end extension connectors 54.

As of Jun. 1, 1999, P4 PVC cement(product name HV P4 Regular PVC Cement, chemical name PVC solvent cement) which is manufactured by William H. Harvey Company has the following physical characteristics:

1. boiling point: 146 degrees Fahrenheit
2. vapor pressure(mm.Hg) 86
3. vapor density(air=1)2.5
4. solubility in water: moderate
5. appearance and odor: slightly viscous clear liquid with ketone odor
6. evaporation rate(bultyl acetate=1)5.7

Components of P4 PVC cement comprise, but not exclusively, tetrahudrofuran, methylethyl ketone and cylclohexanone.

Disattached Lower Slanted Framework

Figure 27:
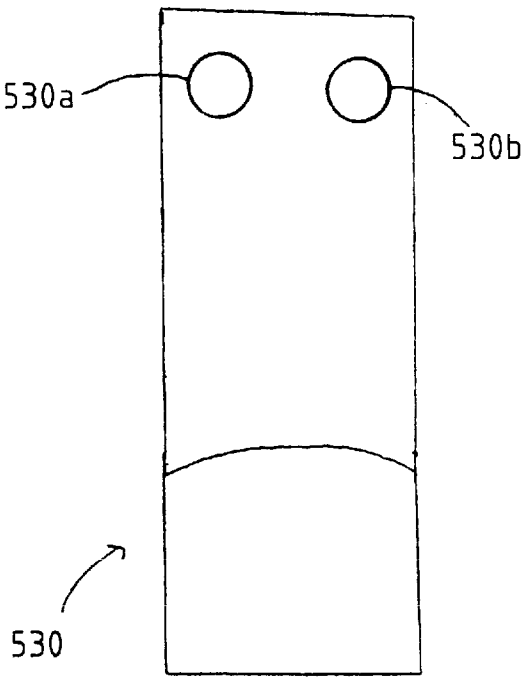
FIG. 27 is a partial plan view of the disattached lower slanted framework beside a reclining bench pad.
Figure 27:
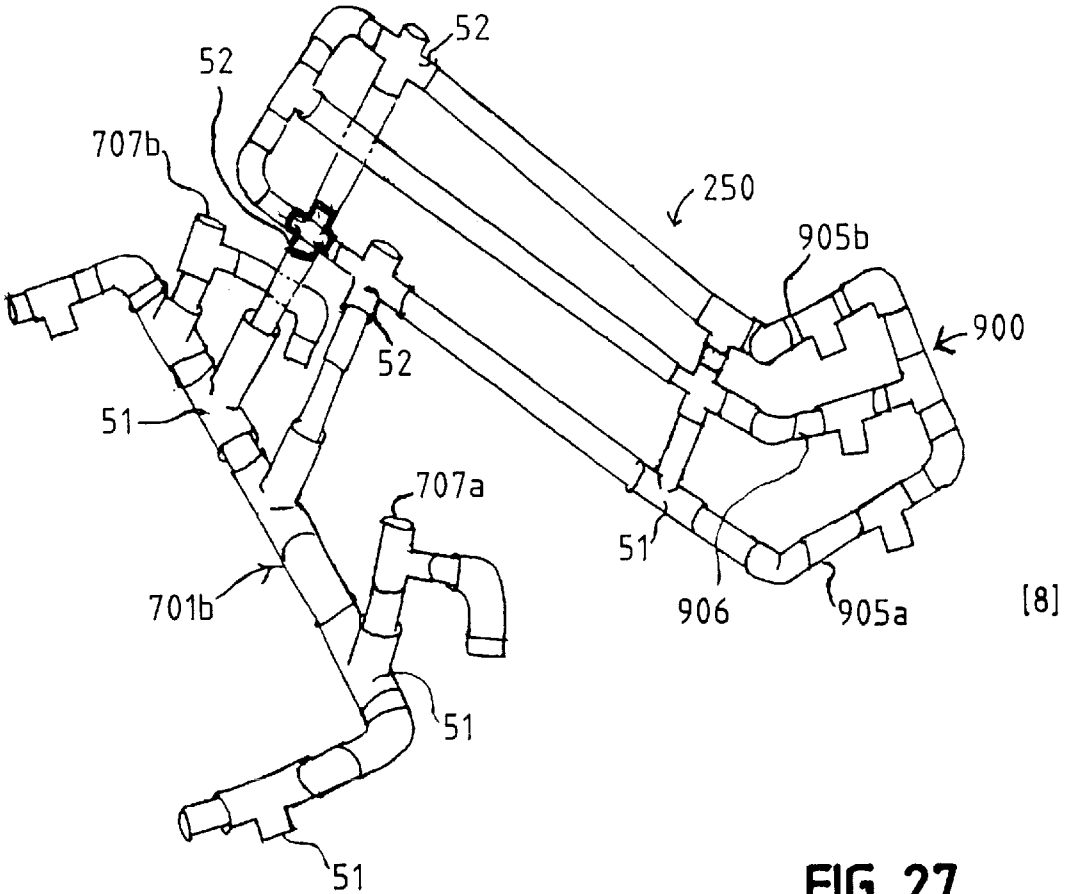
Figure 28:
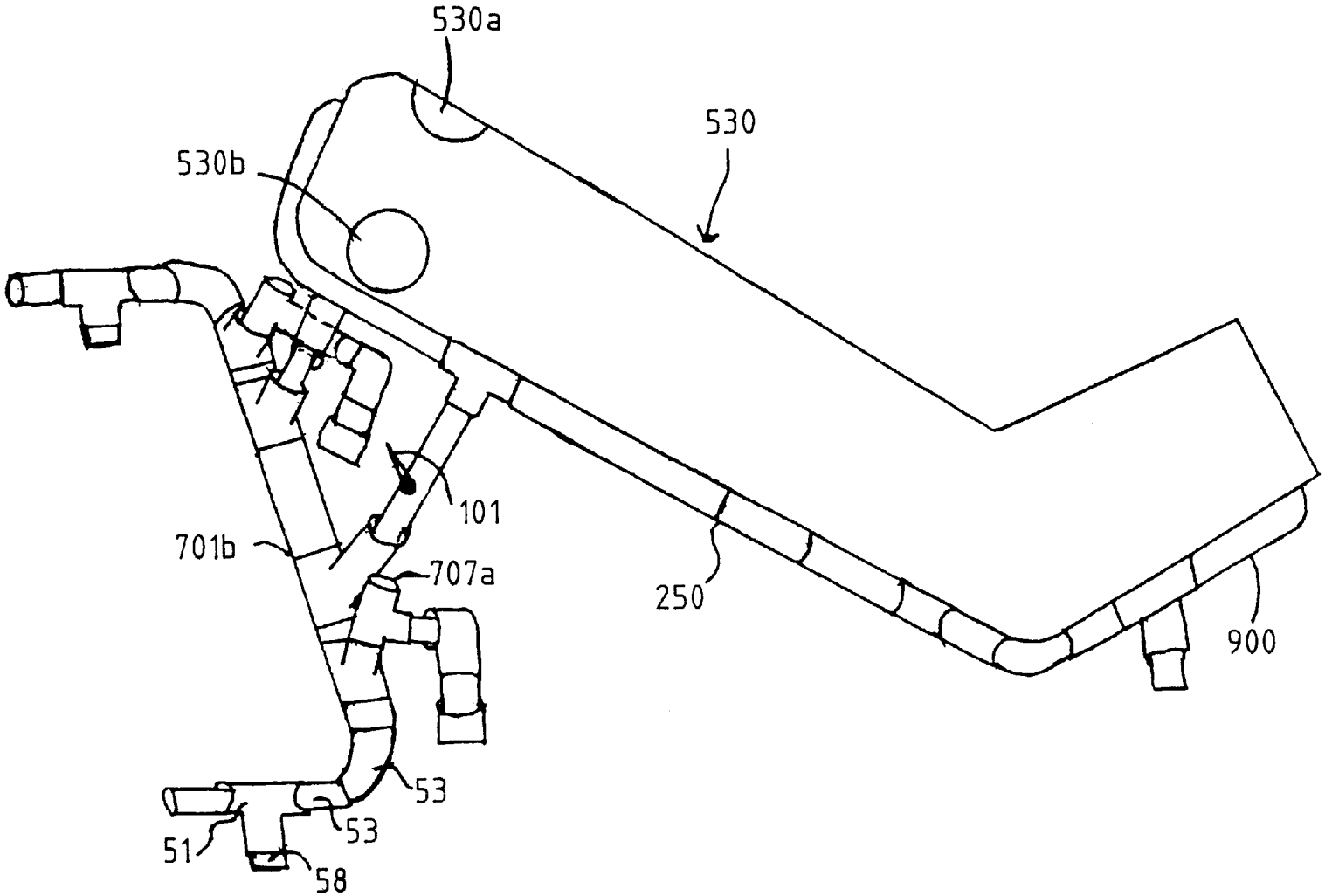
FIG. 28 is a partial lateral view of the disattached lower slanted framework with a mounted reclining bench pad.

Referring now to FIGS. 27 and 28, lower slanted framework 250 can be disattached from the functional reclining multiuse exercise apparatus 100. Reclining pad 530 comprises a first round aperture 530*g* and a second round aperture 530*h* at its upper end. Each round aperture 530*g,* 530*h* is approximately 2 and ½ inches in diameter in the preferred embodiment. Each round aperture 530*g,* 530*h* fits over upper openings 44*a,*44*b* of each t-joint connector 51. These two particular t-joint connectors 51 originally connected the upper surface of lower slanted framework 250 to the lower surface of elevated angled framework 200. In this manner, reclining bench pad 530 is reversibly attached to lower slanted framework 250.

Referring now to FIG. 28, disattached lower slanted framework 250 remains connected to, and partially supported, by second transverse connecting bar 701*b*. However, there are no first vertical support pipes 501*a,* 501*b* or first transverse connecting bar 701*a*. The angle at which the user reclines is flexible, by use of first and second adjustors 630*a,* 630*b*. Lower attachment assembly 900 of disattached lower slanted framework 250 remains supported by third and fourth feet 935*c,* 935*d*.

Lower Slanted Framework/AB Challenger Exercise Apparatus

Referring now to FIG. 27, disattached lower slanted framework 250 can be used in combination with the AB Challenger exercise apparatus. This AB Challenger exercise apparatus is described in its entirety in pending U.S. patent application Ser. Nos. 09/422,671, and 09/422,671 is incorporated by reference in its entirety into this application.

Figure 29:
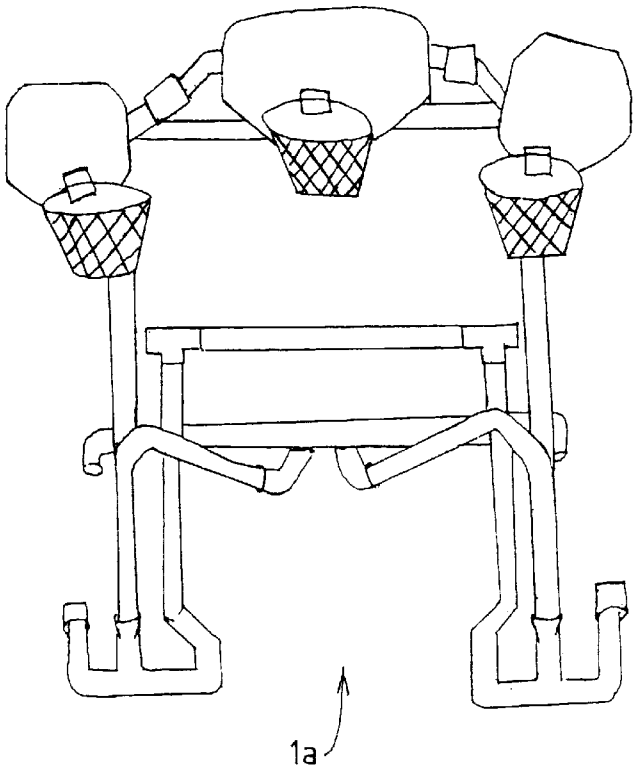
FIG. 29 illustrates a disattached lower slanted framework in combination with an AB Challenger exercise apparatus.
Figure 29:
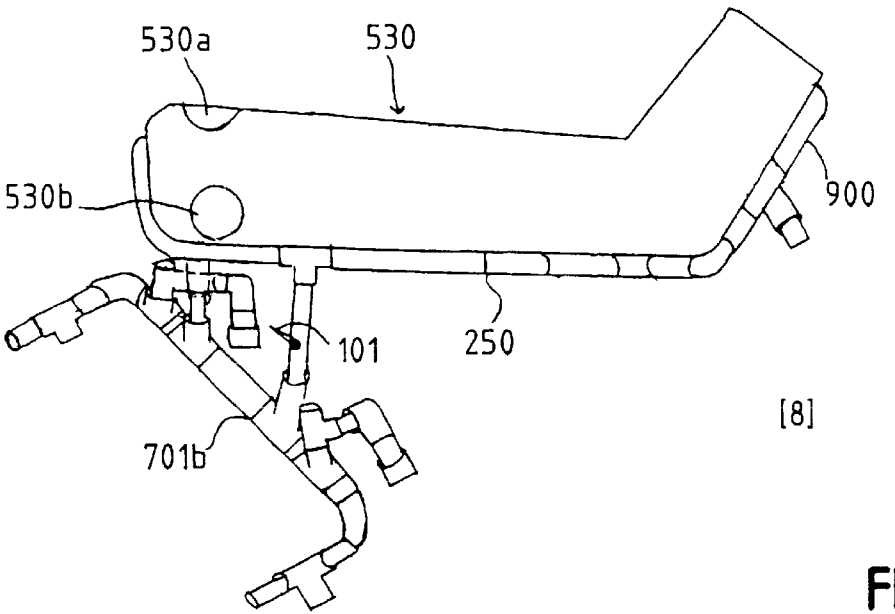

When the user reclines upon the disattached lower framework 250, framework 250 is approximately three feet anterior to the most anterior portion of the AB Challenger exercise apparatus. Please see FIG. 29 The user can either remain reclining or rise to a sitting position to throw a ball through each basketball hoop in sequence.

What is claimed is:

1. A functional reclining multipurpose exercise apparatus, said functional reclining multipurpose exercise apparatus comprising:

(A) an elevated angled framework, said angled framework comprising an upper end and a lower end, said angled framework further comprising an elongated connecting pipe at said upper end, (B) a lower angled framework, said lower slanted framework in parallel relationship to said elevated angled framework, said lower slanted framework connected to said elevated angled framework, said lower slanted framework positioned lower than said elevated angled framework and closer to a rigid horizontal supporting surface, (C) a discontinuous base, said discontinuous base comprising a plurality of transverse pipes along a rigid horizontal supporting surface, (D) a plurality of support pipes, said support pipes connecting said lower angled framework to said discontinuous base, said support pipes further comprising a first angled leg and a second angled leg, (E) a plurality of exercise stretch rubber bands, said rubber bands reversibly encircling said functional multiuse reclining exercise device at predetermined locations, whereby said elevated angled framework and said lower angled framework can support a user reclining or sitting, or leaning upon said upper elevated framework, said upper elevated framework connected to said lower slanted framework and said discontinuous base and said first angled leg and said second angled leg by said support pipes, said support pipes attached to said discontinuous base, said elevated angled framework adaptable to a plurality of muscle exercises with said exercise stretch rubber bands.

2. The functional reclining multiuse exercise apparatus as described in claim 1 wherein said functional reclining multiuse exercise apparatus comprises bunge cords.

3. The functional reclining multiuse exercise apparatus as described in claim 2, wherein said functional-reclining multiuse exercise apparatus comprises a removable framework reclining pad.

4. The functional reclining multiuse exercise apparatus as described in claim 3, wherein said functional reclining multiuse exercise apparatus comprises a removable framework sitting pad.

5. The functional reclining multiuse exercise apparatus as described in claim 4 wherein said functional reclining multiuse exercise apparatus comprises vertical height adjustors.

6. The functional reclining multiuse exercise apparatus as described in claim 5 wherein said functional reclining multiuse exercise apparatus comprises slanted adjustors.

7. The functional reclining multiuse exercise apparatus as described in claim 6 wherein said apparatus comprises a plurality of polyvinychloride pipes.

8. The functional reclining multiuse exercise apparatus as described in claim 7 wherein said apparatus comprises removable a horizontal leg support bar.

* * * * *